US012571277B2

(12) United States Patent
Trumbull et al.

(10) Patent No.: US 12,571,277 B2
(45) Date of Patent: Mar. 10, 2026

(54) ISOLATION SLEEVE

(71) Applicant: CACTUS WELLHEAD, LLC, Houston, TX (US)

(72) Inventors: Martin Anthony Trumbull, Hockley, TX (US); Thomas Henry Holtkamp, Friendswood, TX (US)

(73) Assignee: CACTUS WELLHEAD, LLC, Houston, TX (US)

( * ) Notice: Subject to any disclaimer, the term of this patent is extended or adjusted under 35 U.S.C. 154(b) by 0 days.

(21) Appl. No.: 19/222,269

(22) Filed: May 29, 2025

(65) Prior Publication Data

US 2025/0290383 A1 Sep. 18, 2025

Related U.S. Application Data

(63) Continuation of application No. 17/233,499, filed on Apr. 18, 2021, now Pat. No. 12,338,703.

(60) Provisional application No. 63/013,421, filed on Apr. 21, 2020.

(51) Int. Cl.

| | |
|---|---|
| ***E21B 33/03*** | (2006.01) |
| ***E21B 33/04*** | (2006.01) |
| ***E21B 33/043*** | (2006.01) |

(52) U.S. Cl.

CPC ..... *E21B 33/043* (2013.01); *E21B 33/0422* (2013.01); *E21B 2200/01* (2020.05)

(58) Field of Classification Search

CPC ..... E21B 33/03; E21B 33/04

See application file for complete search history.

(56) References Cited

U.S. PATENT DOCUMENTS 2,478,628 A * 8/1949 Charles ..... E21B 33/04 285/96
3,087,547 A * 4/1963 Raulins ..... E21B 33/04 166/89.1
3,273,915 A * 9/1966 Robert ..... E21B 33/043 166/338
3,299,954 A * 1/1967 Williams ..... E21B 33/043 166/348
3,454,088 A * 7/1969 Gibbs ..... E21B 33/0422 166/124
3,540,533 A * 11/1970 Morrill ..... E21B 33/043 166/344
4,003,434 A * 1/1977 Garrett ..... E21B 33/043 166/212
4,342,363 A * 8/1982 Reed ..... E21B 34/02 166/95.1
4,362,210 A * 12/1982 Green ..... E21B 17/1007 285/39
4,532,987 A * 8/1985 Reed ..... E21B 33/03 285/123.3
4,657,075 A * 4/1987 McLeod ..... E21B 33/068 166/196

(Continued)

*Primary Examiner* — Kipp C Wallace

(74) *Attorney, Agent, or Firm* — Ewing & Jones, PLLC

(57) ABSTRACT

An isolation sleeve for a wellbore includes a sleeve body and a torque sleeve. The torque sleeve threadedly couples to the sleeve body. The torque sleeve includes a compression shoulder. The isolation sleeve includes a compression seal positioned about the torque sleeve between the compression shoulder and the sleeve body. The isolation sleeve also includes a lock ring coupled to the sleeve body that engages a packoff. The lock ring is urged into engagement with the packoff by an energizing ring.

13 Claims, 20 Drawing Sheets

(56) References Cited

U.S. PATENT DOCUMENTS 4,691,770 A * 9/1987 McLeod ..... E21B 33/128 166/73
4,691,780 A * 9/1987 Galle, Jr. ..... E21B 33/043 166/368
4,862,960 A * 9/1989 Garbett ..... E21B 47/117 73/40.5 R
4,900,041 A * 2/1990 Hopkins ..... E21B 33/04 166/115
5,090,737 A * 2/1992 Brammer ..... E21B 17/085 285/348
5,158,326 A * 10/1992 Anderson ..... F16L 17/10 285/123.9
5,255,743 A * 10/1993 Adam ..... E21B 33/038 166/368
5,287,925 A * 2/1994 Watkins ..... E21B 33/0422 166/208
5,368,335 A * 11/1994 Dinnes ..... E21B 33/038 285/308
5,465,794 A * 11/1995 McConaughy ..... E21B 34/10 166/382
6,571,877 B1 * 6/2003 Van Bilderbeek ..... E21B 33/03 166/368
7,207,384 B2 * 4/2007 Dallas ..... E21B 47/117 166/75.13
7,308,934 B2 * 12/2007 Swagerty ..... E21B 43/2607 166/177.5
9,121,243 B1 * 9/2015 Headifen ..... E21B 33/038
2002/0062964 A1 * 5/2002 Allen ..... E21B 33/04 166/368
2002/0074124 A1 * 6/2002 Cunningham ..... E21B 33/043 166/360
2008/0087415 A1 * 4/2008 McGuire ..... E21B 17/1007 166/85.1
2009/0078404 A1 * 3/2009 Schepp ..... E21B 33/04 166/75.14
2010/0193195 A1 * 8/2010 Nguyen ..... E21B 23/00 166/338
2010/0230114 A1 * 9/2010 Jennings ..... E21B 43/2607 166/381
2011/0198072 A1 * 8/2011 Cote ..... E21B 33/068 166/75.11
2012/0043094 A1 * 2/2012 Anderson ..... E21B 33/04 166/382
2013/0175055 A1 * 7/2013 Hart ..... E21B 33/03 166/97.1
2013/0213671 A1 * 8/2013 Reimert ..... E21B 33/035 166/75.13
2014/0182847 A1 * 7/2014 Cronley ..... E21B 33/068 166/75.13
2015/0267479 A1 * 9/2015 Benson ..... E21B 33/068 166/85.3
2023/0228167 A1 * 7/2023 Pang ..... E21B 34/02 166/250.01

* cited by examiner

ISOLATION SLEEVE

CROSS-REFERENCE TO RELATED APPLICATIONS

This application is a continuation application which claims priority from U.S. utility application Ser. No. 17/233,499, filed Apr. 18, 2021, which is itself a nonprovisional application which claims priority from U.S. provisional application No. 63/013,421, filed Apr. 21, 2020, each of which is incorporated by reference herein in its entirety.

TECHNICAL FIELD/FIELD OF THE DISCLOSURE

The present disclosure relates generally to wellheads and specifically to sealing devices for wellheads.

BACKGROUND OF THE DISCLOSURE

When completing a well, a wellhead is positioned at the surface to support and seal against various tools. Typically, a section of liner or casing, known as a tieback string, is positioned into the wellbore coupled between a liner hanger within the wellbore and the wellhead once the liner hanger is installed and cemented. The tieback string is typically sealingly coupled to the wellhead. However, because the tieback string extends at least partially through the wellhead, the seals of the wellhead may be exposed to fluids within the annulus of the wellbore. In some cases, corrosive or otherwise reactive chemicals from within the wellbore may come into contact with the wellhead, potentially damaging components of the wellhead including the wellhead seals. Such damage may necessitate costly repairs or may cause an unsafe environment due to the risk of failure of one or more components of the wellhead.

SUMMARY

The present disclosure provides for an isolation sleeve. The isolation sleeve may include a sleeve body and a torque sleeve, the torque sleeve threadedly coupled to the sleeve body. The torque sleeve may include a compression shoulder. The isolation sleeve may further include a compression seal positioned about the torque sleeve between the compression shoulder and the sleeve body. The isolation sleeve may further include a lock ring coupled to the sleeve body. The lock ring may be urged into engagement with the packoff by an energizing ring.

The present disclosure also provides for a wellhead. The wellhead may include a wellhead housing coupled to a wellbore at the surface. The wellhead may further include a casing coupled to the wellhead housing, the casing extending into the wellbore. The wellhead may further include a packoff positioned within the wellhead housing. The wellhead may further include an isolation sleeve. The isolation sleeve may include a sleeve body positioned within the packoff and a torque sleeve, the torque sleeve threadedly coupled to the sleeve body. The torque sleeve may include a compression shoulder. The isolation sleeve may further include a compression seal positioned about the torque sleeve between the compression shoulder and the sleeve body, the compression seal sealingly engaging the casing. The isolation sleeve may further include a lock ring coupled to the sleeve body. The lock ring may engage the packoff and may be urged into engagement with the packoff by an energizing ring.

The present disclosure also provides for an isolation sleeve. The isolation sleeve may include a sleeve body and a torque sleeve, the torque sleeve threadedly coupled to the sleeve body. The torque sleeve may include a compression shoulder. The isolation sleeve may further include a compression seal positioned about the torque sleeve between the compression shoulder and the sleeve body. The isolation sleeve may further include a seal ring positioned about the sleeve body. The isolation sleeve may further include an upper body seal positioned between the seal ring and the sleeve body.

The present disclosure also provides for a wellhead. The wellhead may include a wellhead housing coupled to a wellbore at the surface. The wellhead may further include one or more lockscrews threadedly coupled to and extending radially through the wall of the wellhead housing. The wellhead may further include a casing coupled to the wellhead housing, the casing extending into the wellbore. The wellhead may further include an isolation sleeve. The isolation sleeve may include a sleeve body positioned within the wellhead housing and a torque sleeve, the torque sleeve threadedly coupled to the sleeve body. The torque sleeve may include a compression shoulder. The isolation sleeve may further include a compression seal positioned about the torque sleeve between the compression shoulder and the sleeve body, the compression seal sealingly engaging the casing. The isolation sleeve may further include a seal ring positioned about the sleeve body, the seal ring in engagement with the lockscrews. The isolation sleeve may further include an upper body seal positioned between the seal ring and the sleeve body.

The present disclosure also provides for a method. The method may include positioning a casing within a wellbore, coupling a wellhead housing to the wellbore and to the casing, and providing an isolation sleeve. The isolation sleeve may include a sleeve body positioned within the packoff and a torque sleeve threadedly coupled to the sleeve body. The torque sleeve may include a compression shoulder. The isolation sleeve may include a compression seal positioned about the torque sleeve between the compression shoulder and the sleeve body. The method may further include inserting the isolation sleeve into the wellhead housing such that the compression seal is positioned within the casing, rotating the torque sleeve relative to the sleeve body, and compressing the compression seal along the direction of travel of the torque sleeve.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
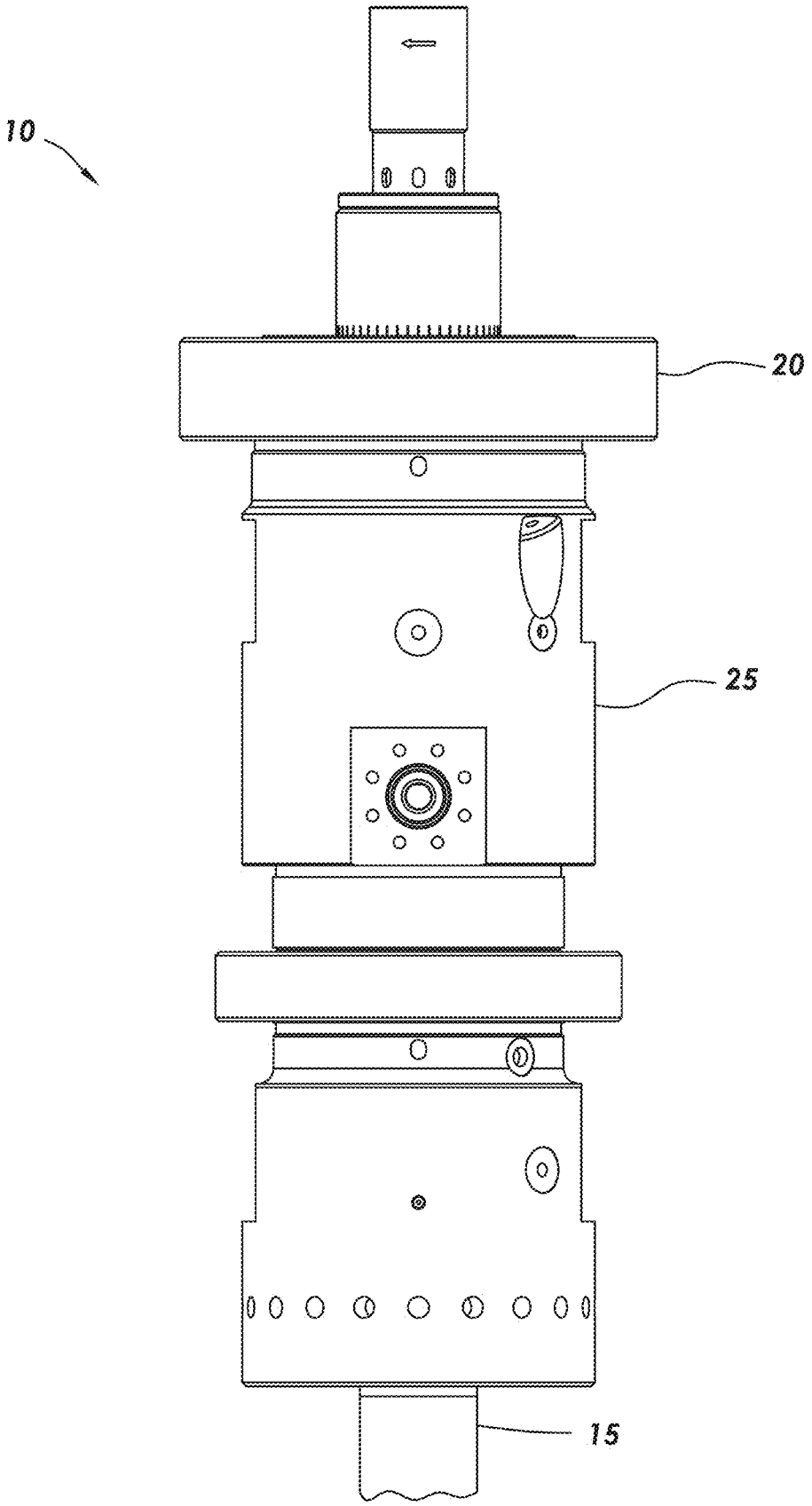
FIG. 1 is an elevation view of a wellhead consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts wellhead 10. Wellhead 10 may be coupled to the upper end of wellbore 15 and may be positioned to allow one or more pieces of equipment to be introduced into wellbore 15 while sealing the annulus of wellbore 15. Wellhead 10 may include, among other elements, tubing head 20 and wellhead housing 25. Tubing head 20 may, in some embodiments, be used to support a tubing hanger for use in wellbore 15.

Figure 2:
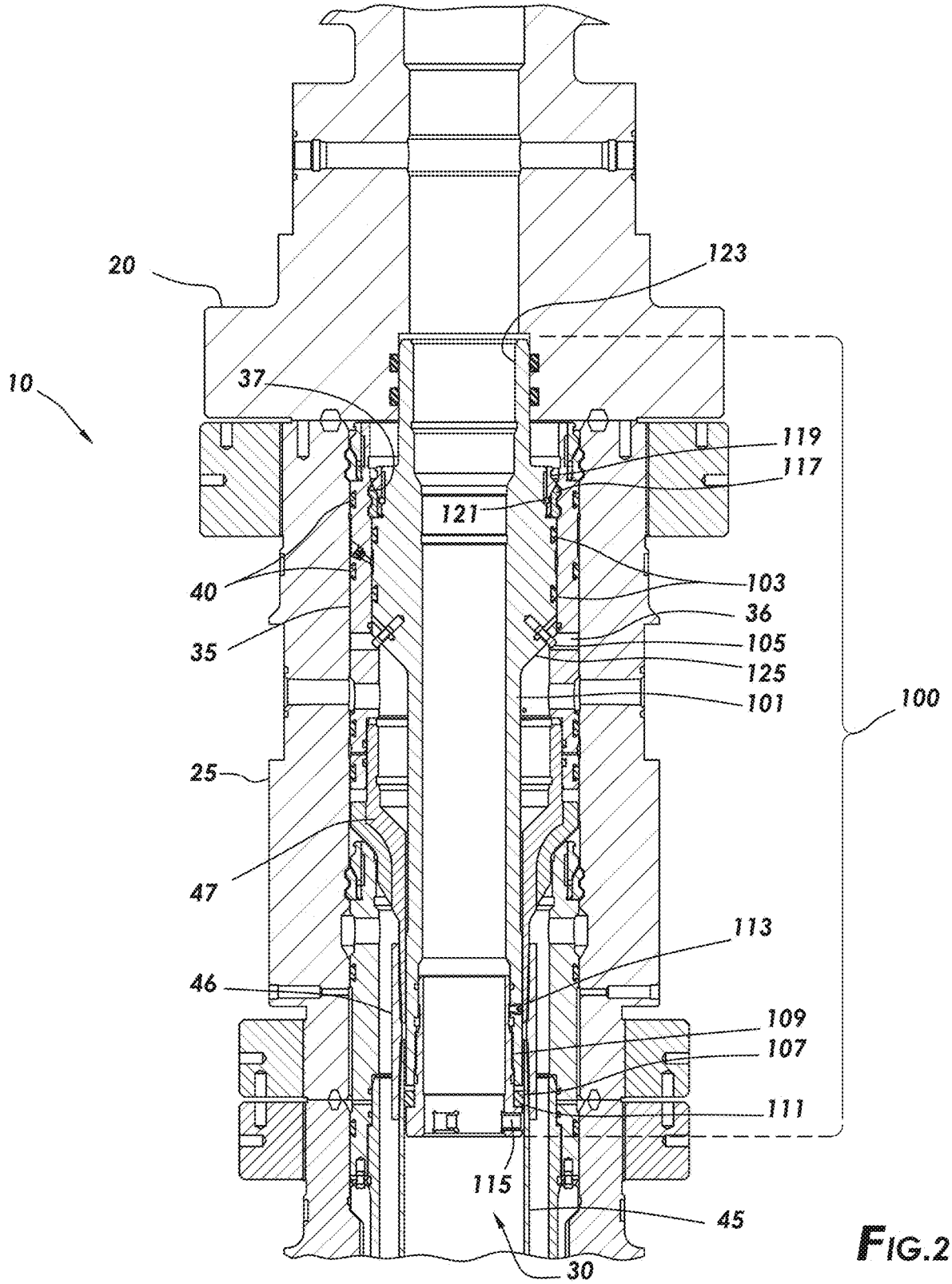
FIG. 2 is a cross section view of a wellhead having an isolation sleeve consistent with at least one embodiment of the present disclosure installed thereto.

As shown in FIG. 2, tubing head 20 and wellhead housing 25 are tubular or generally tubular and the interior thereof defines bore 30 of wellhead 10. In some embodiments, packoff 35 is positioned within wellhead housing 25. Packoff 35 may be tubular or generally tubular and may be used to seal bore 30 within wellhead 10 during operation. Wellhead 10 may include one or more seals 40 positioned between packoff 35 and wellhead housing 25. In some embodiments, seals 40 may be retained by packoff 35 and installed into wellhead housing 25 therewith. In some embodiments, casing 45 may be coupled to wellhead 10. Casing 45 may be an uppermost portion of a casing string positioned within wellbore 15. In some embodiments, casing 45 may be coupled to wellhead 10 by various components such as, for example and without limitation, casing collar 46 and casing hanger 47. Casing hanger 47 may abut wellhead housing 25 and may be used to support, along with casing collar 46, the casing string as shown by casing 45.

FIGS. 2-5 depict isolation sleeve 100. In some embodiments, isolation sleeve 100 may include sleeve body 101. Sleeve body 101 may be tubular or generally tubular and may be formed such that sleeve body 101 fits within packoff 35 when installed to wellhead 10 as shown in FIG. 2.

In some embodiments, isolation sleeve 100 may include one or more isolation seals 103 positioned to abut between sleeve body 101 and packoff 35. In other embodiments, one or more isolation seals 103 may be positioned on packoff 35 without deviating from the scope of this disclosure.

Isolation sleeve 100 may include one or more antirotation features positioned to engage with one or more corresponding antirotation features of packoff 35. For example, in some embodiments, isolation sleeve 100 may include one or more antirotation pins 105 positioned to engage slots 36 formed in packoff 35 once isolation sleeve 100 is installed to wellhead 10. Antirotation pins 105 may fit into slots 36 such that rotational forces applied to isolation sleeve 100 are transferred to wellhead 10 via antirotation pins 105, thereby reducing or preventing relative rotation between sleeve body 101 and wellhead 10. In some embodiments, antirotation pins 105 may be spring-loaded.

In some embodiments, isolation sleeve 100 may include compression seal 107. Compression seal 107 may be positioned to seal against the inner surface of casing 45 when actuated as further described herein below. Compression seal 107 may be annular and may be formed from an elastomer.

Figure 3:
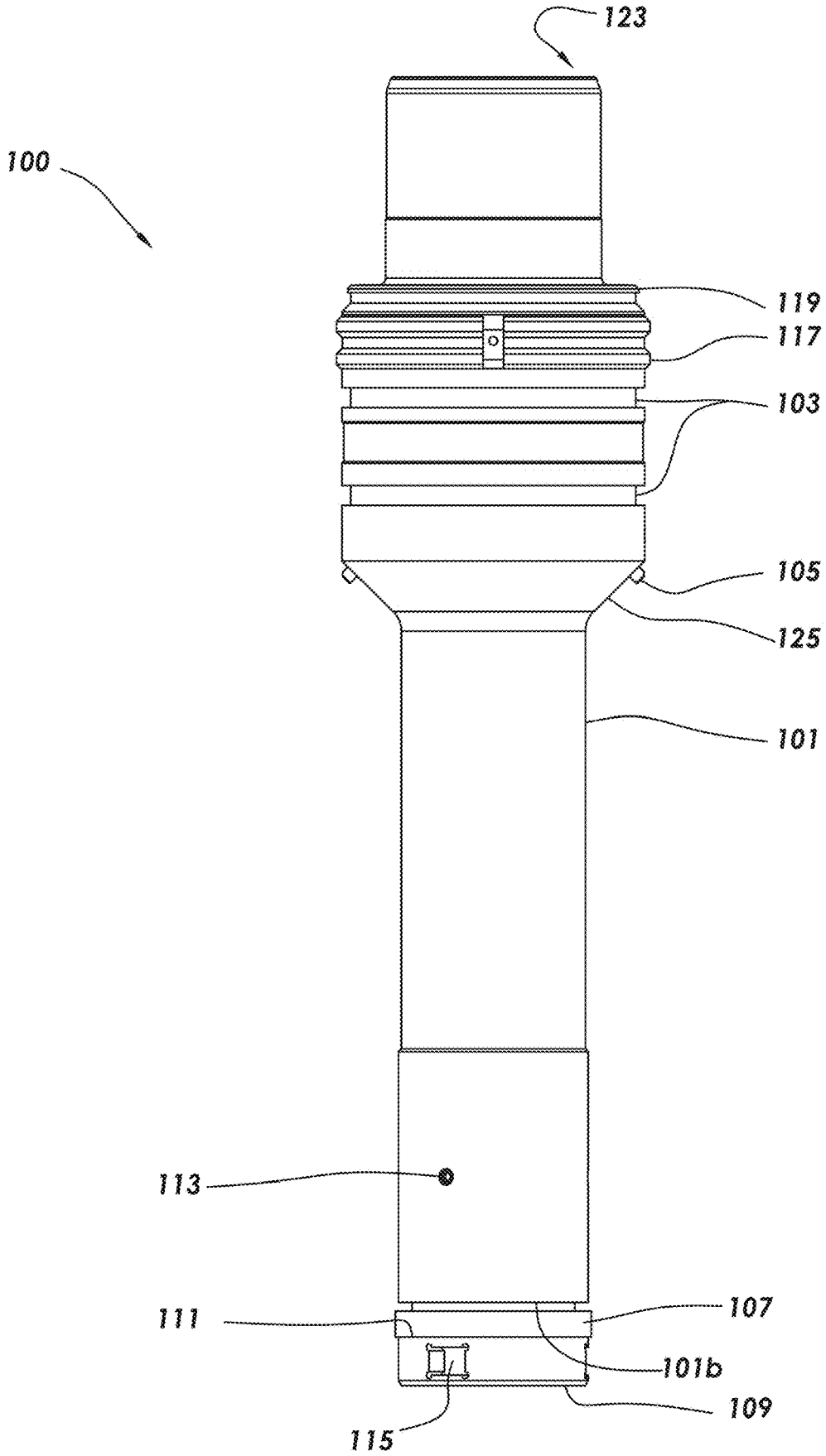
FIG. 3 is an elevation view of an isolation sleeve consistent with at least one embodiment of the present disclosure.
Figure 4:
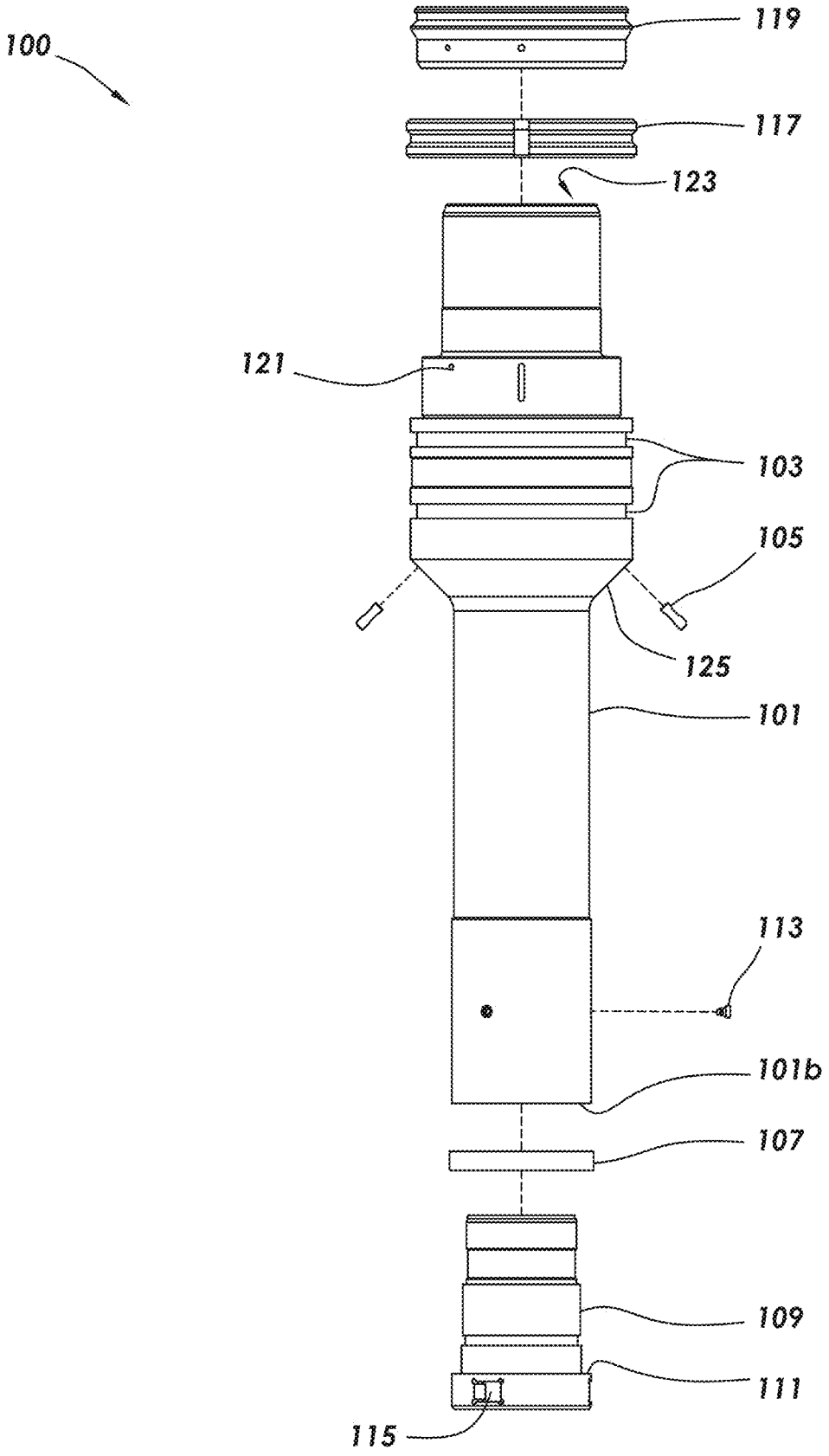
FIG. 4 is an exploded view of the isolation sleeve of FIG. 3.
Figure 5:
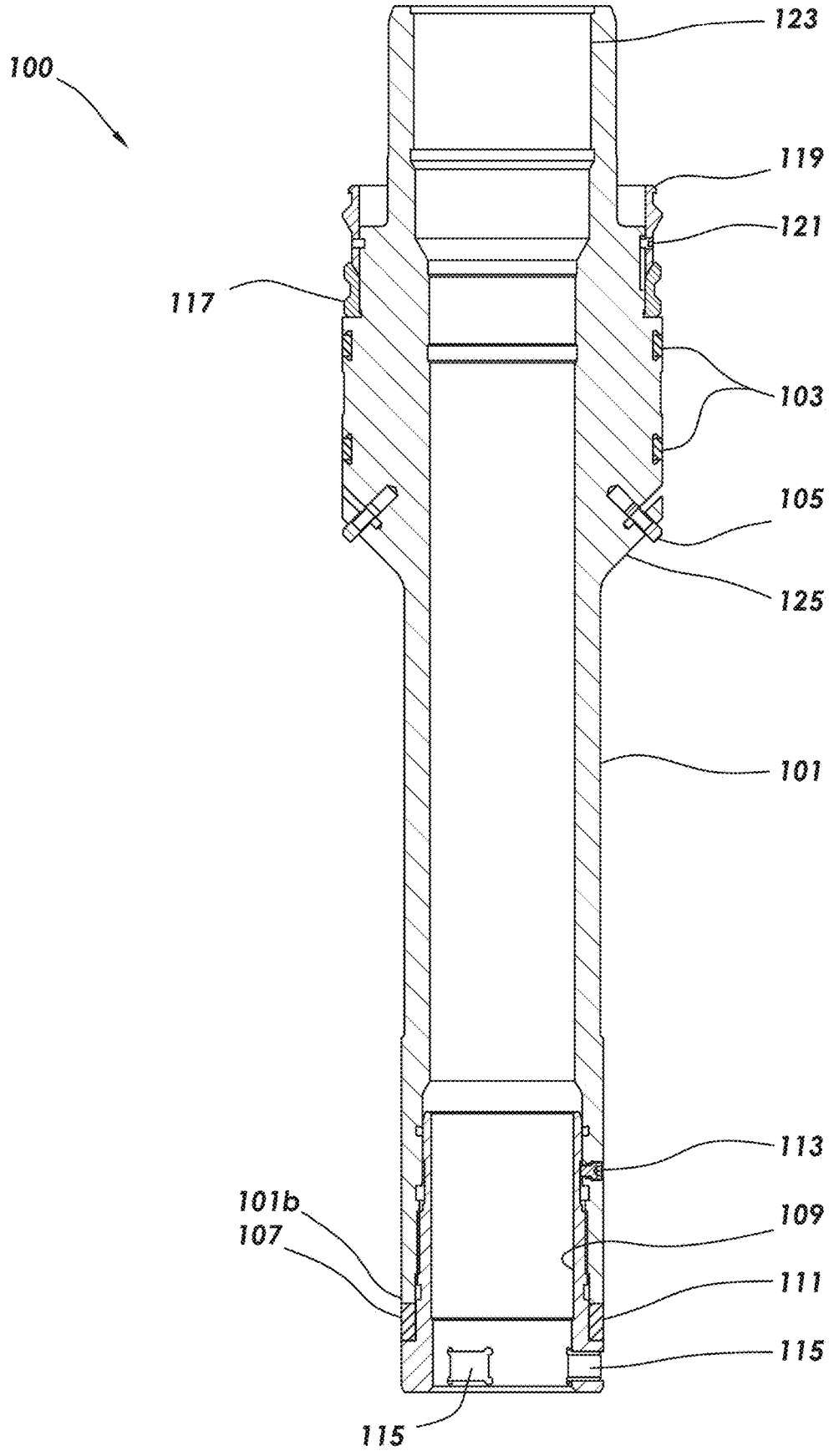
FIG. 5 is a cross section view of the isolation sleeve of FIG. 3.
Figure 19:
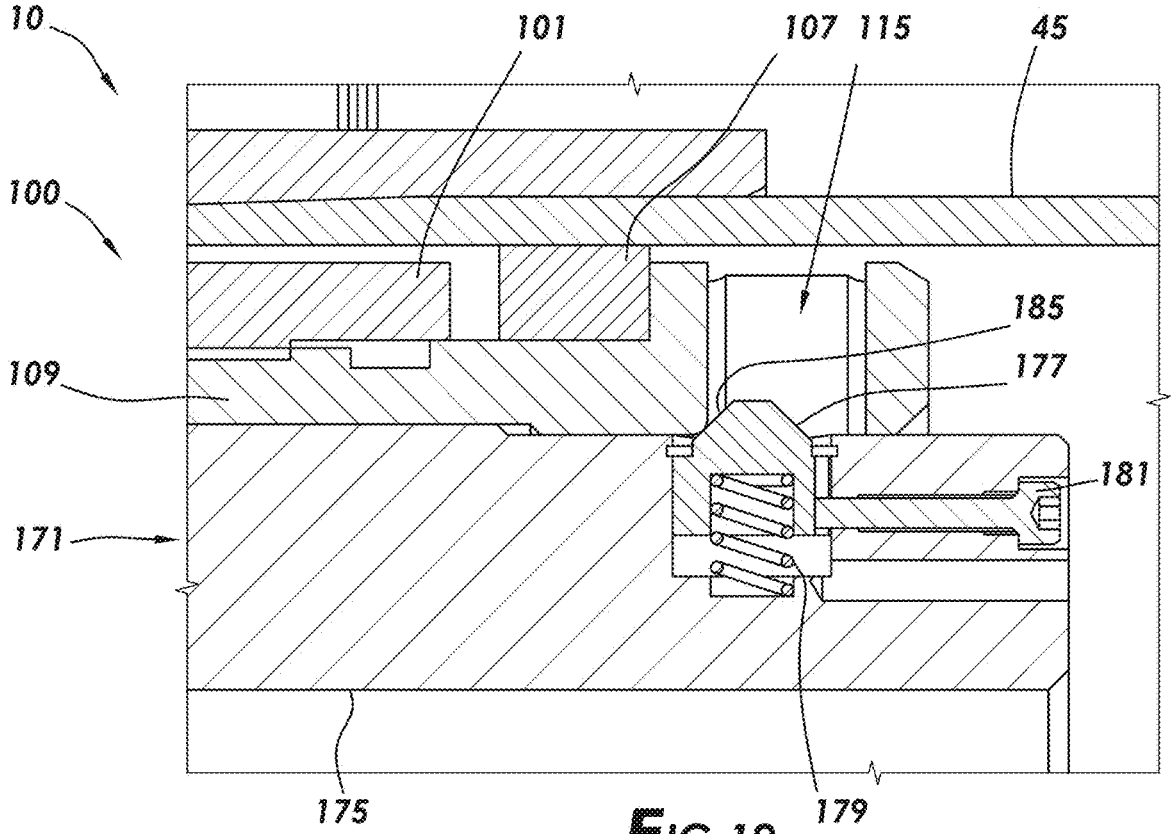
FIG. 19 is a detail view of the torque tool of FIG. 16 engaged to the isolation sleeve of FIG. 16 in a run-in configuration.

In some embodiments, isolation sleeve 100 may include torque sleeve 109. Torque sleeve 109 may be tubular or generally tubular and may be used, as described herein below, to set isolation sleeve 100 in the set position. Torque sleeve 109 may threadedly couple to lower end 101*b* of sleeve body 101. Compression seal 107 may be positioned about torque sleeve 109. Torque sleeve 109 may include compression shoulder 111 positioned to abut compression seal 107. When in a run-in configuration as shown in FIG. 3 (and in detail in FIG. 19), torque sleeve 109 is coupled to sleeve body 101 such that compression seal 107 is not compressed or is only slightly compressed between lower end 101*b* of sleeve body 101 and compression shoulder 111 such that the outer diameter of compression seal 107 is less than the diameter of components of wellhead 10 and casing 45. When isolation sleeve is moved to a set configuration as further discussed herein below and as shown in FIG. 2 (and in detail in FIG. 20), torque sleeve 109 is further threadedly engaged to sleeve body 101, causing compression seal 107 to be compressed along the axis of isolation sleeve 100. Compression seal 107 is extruded radially outward into contact with casing 45, thereby reducing or preventing fluid flow between isolation sleeve 100 and casing 45 and into bore 30 of wellhead 10.

In some embodiments, isolation sleeve 100 may include one or more positive stop features 113 positioned to, for example and without limitation, prevent torque sleeve 109 from fully disengaging from sleeve body 101, thereby reducing the likelihood that torque sleeve 109 is inadvertently fully disengaged from sleeve body 101. Positive stop features 113 may include one or more of, for example and without limitation, bolts, pins, protrusions, or detents.

In some embodiments, torque sleeve 109 may include one or more rotation slots 115. Rotation slots 115 may be used to engage torque sleeve 109 to a torque tool as further discussed below such that the torque tool can rotate torque sleeve 109.

In some embodiments, isolation sleeve 100 may include one or more lock features positioned to allow isolation sleeve 100 to be locked to wellhead 10. For example and without limitation, in some embodiments, isolation sleeve 100 may include lock ring 117. Lock ring 117 may be annular and may be coupled to sleeve body 101 such that lock ring 117 corresponds with the position of lock groove 37 of packoff 35 when isolation sleeve 100 is installed to wellhead 10. In some such embodiments, isolation sleeve 100 may further include energizing ring 119. Energizing ring 119 may, during a locking operation as further described herein below, be urged between sleeve body 101 and lock ring 117 such that lock ring 117 is urged radially outward and into engagement with lock groove 37 of packoff 35, thereby retaining isolation sleeve 100 to wellhead 10. In some embodiments, one or more retention features may be positioned between energizing ring 119 and sleeve body 101 to retain energizing ring 119 and lock ring 117 in the unlocked position until locking is desired. For example, in some embodiments, one or more shear pins 121 may be so positioned.

In some embodiments, sleeve body 101 may include upper threaded receiver 123 positioned to allow other tools to threadedly couple to the upper end of isolation sleeve 100. In some embodiments, sleeve body 101 may include landing shoulder 125 positioned to engage with packoff 35 when isolation sleeve 100 is fully inserted into wellhead 10.

Figure 6:
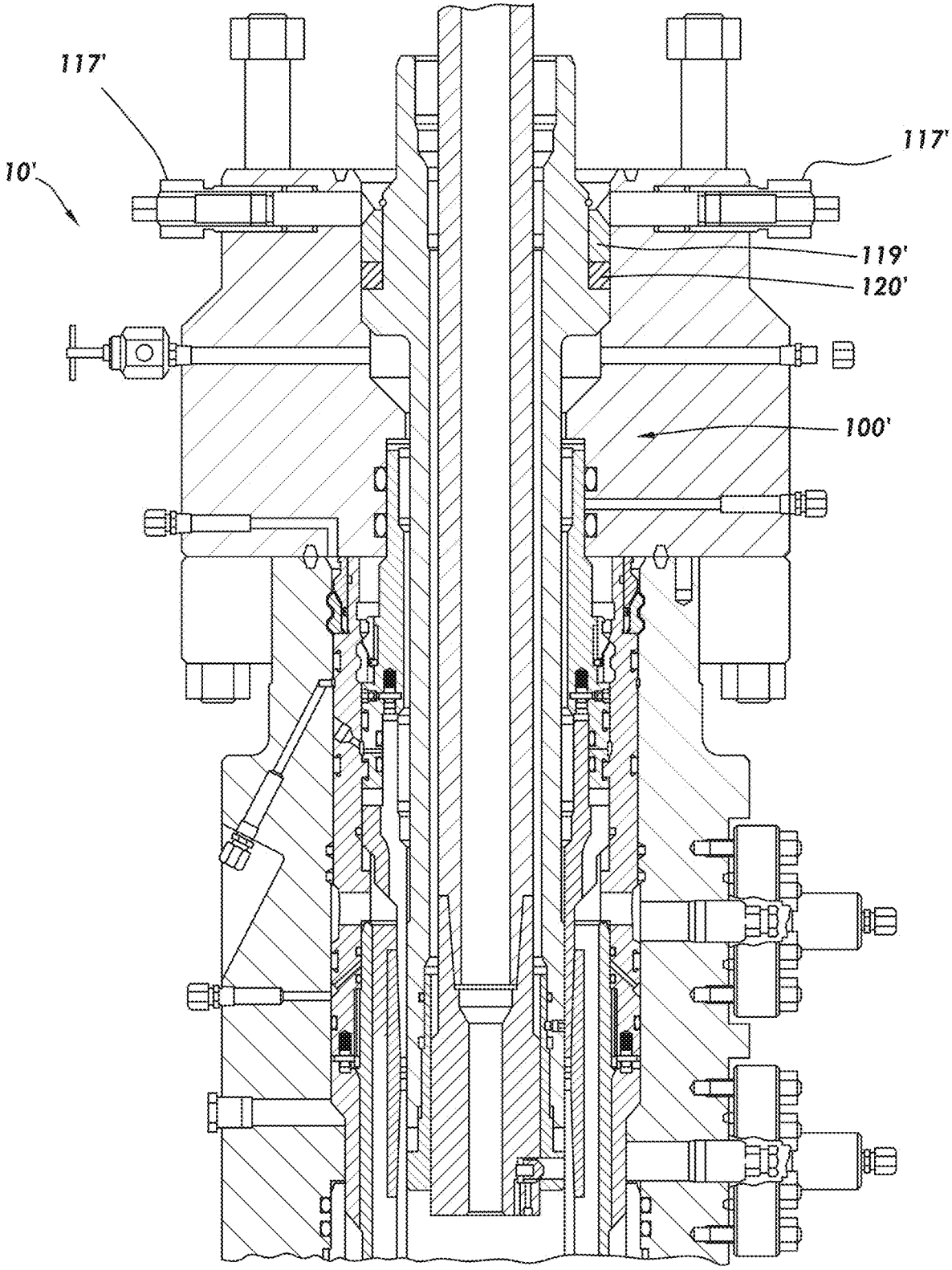
FIG. 6 is a cross section view of a wellhead having an isolation sleeve consistent with at least one embodiment of the present disclosure installed thereto.
Figure 7:
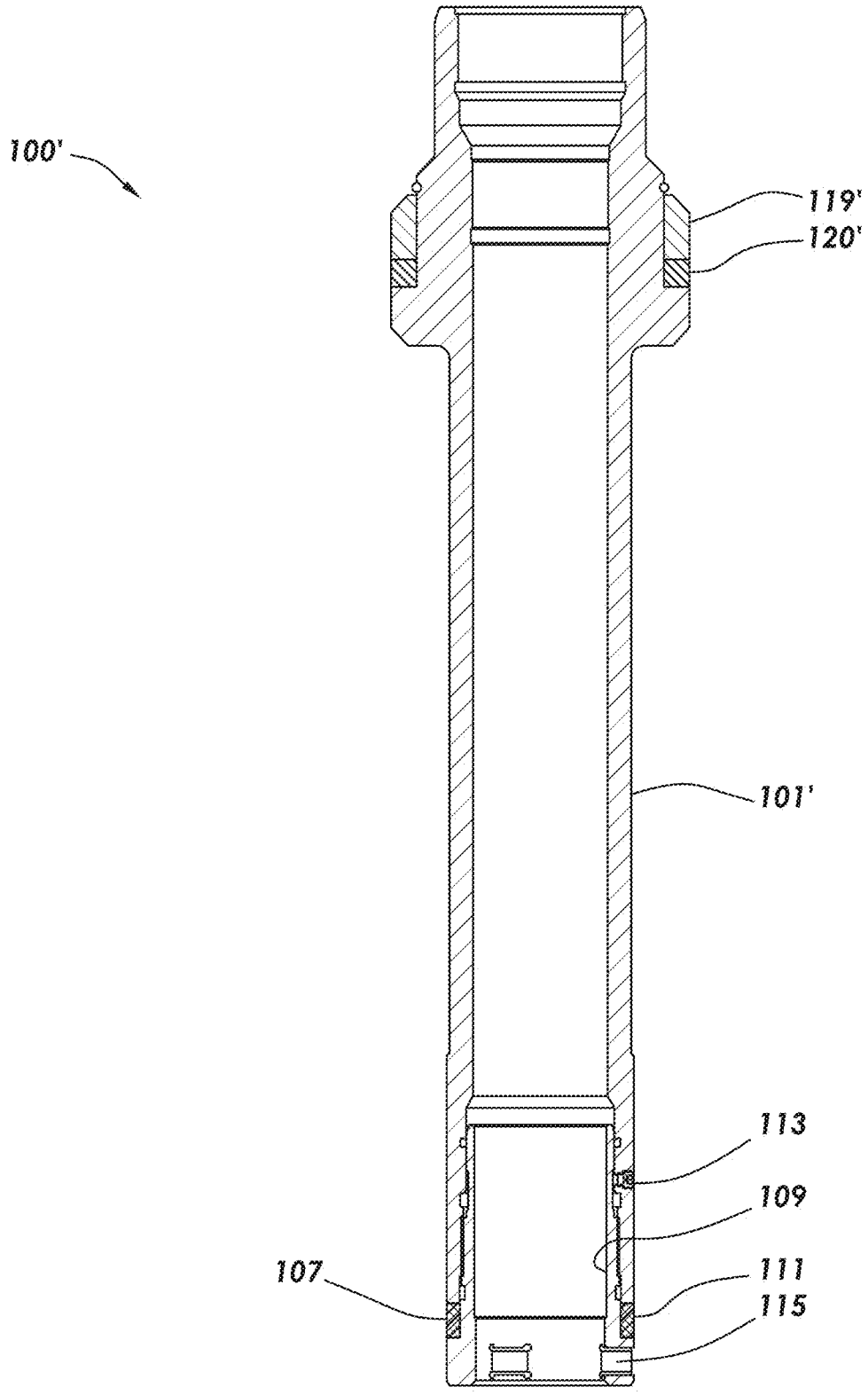
FIG. 7 is a cross section view of the isolation sleeve of FIG. 6.

In other embodiments, as shown in FIGS. 6 and 7, wellhead 10' may retain sleeve body 101' of isolation sleeve 100' to wellhead 10' using one or more lockscrews 117'. Lockscrews 117' may extend radially through the wall of wellhead 10'. In some such embodiments, isolation sleeve 100' may include seal ring 119' and upper body seal 120'. In such an embodiment, lockscrews 117' may engage seal ring 119' and may urge seal ring 119' against upper body seal 120' such that upper body seal 120' is compressed along the longitudinal axis of isolation sleeve 100' and is thereby urged radially outward into engagement with wellhead 10'. In some such embodiments, isolation sleeve 100' may otherwise operate as described herein with respect to isolation sleeve 100.

Figure 8:
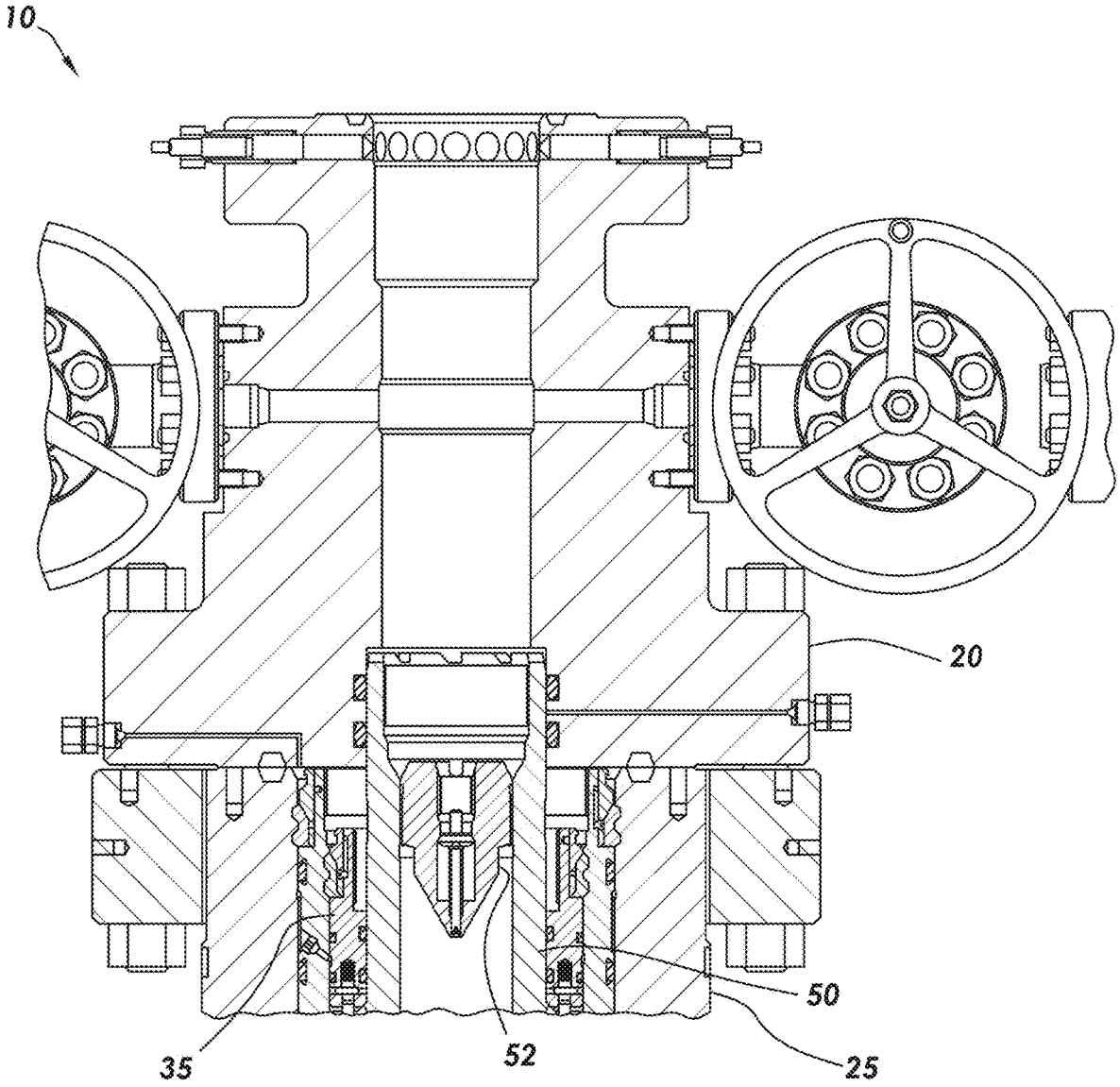
FIG. 8 is a cross section view of a wellhead in the process of having an isolation sleeve consistent with at least one embodiment of the present disclosure installed thereto.

Isolation sleeve 100 may be installed to wellhead 10 originally or may be installed to wellhead 10 during an intervention into operations of wellbore 15. For example, FIGS. 8-21 depict a nonlimiting example of an installation operation for isolation sleeve 100 to wellhead 10 consistent with at least one embodiment of the present disclosure wherein a tieback string, denoted tieback string 50 in FIG. 8, is already positioned within wellbore 15 and is coupled to wellhead 10. As can be seen, bore 30 of wellhead 10 is exposed to wellbore 15 as tieback string 50 seals directly against packoff 35 and there are no seals between tieback string 50 and casing 45. Therefore, any corrosive or otherwise reactive fluids within wellbore 15 may come into contact with packoff 35 and other components of wellhead 10. In the event that such conditions are encountered during operation of wellbore 15 with wellhead 10 engaged thereto, it may be desirable to replace tieback string 50 with isolation sleeve 100 such that such exposure is reduced or prevented.

To install isolation sleeve 100 to wellhead 10, wellhead 10 is at least partially dismantled and tieback string 50 is removed therefrom. Depending on the configuration of wellhead 10, the operations required to dismantle wellhead 10 may vary from those discussed herein. The following discussion is intended to be exemplary and other configurations of wellhead 10 are contemplated within the scope of this disclosure.

Figure 9:
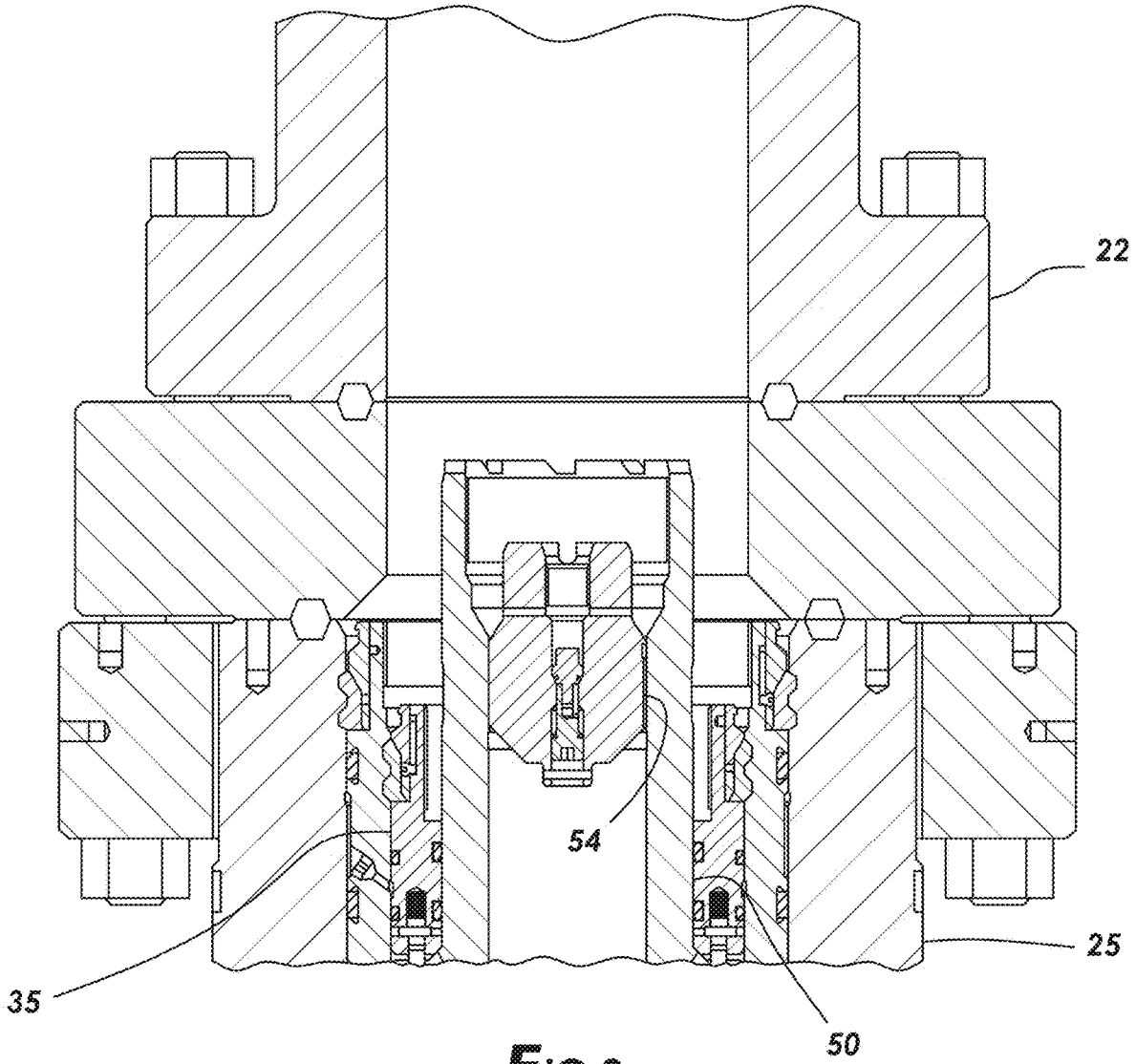
FIG. 9 is a cross section view of the wellhead of FIG. 8 with tubing head removed and BOP stack added.

For example, in some embodiments, during such a replacement operation, back pressure valve (BPV) 52 may be installed to tieback string 50 as shown in FIG. 8. Tubing head 20 may then be removed from wellhead housing 25 and replaced with blowout preventer stack (BOP) 22 as shown in FIG. 9. In some embodiments, two-way BPV 54 may be installed to tieback string 50 to, for example and without limitation, allow pressure testing of BOP 22.

Figure 10:
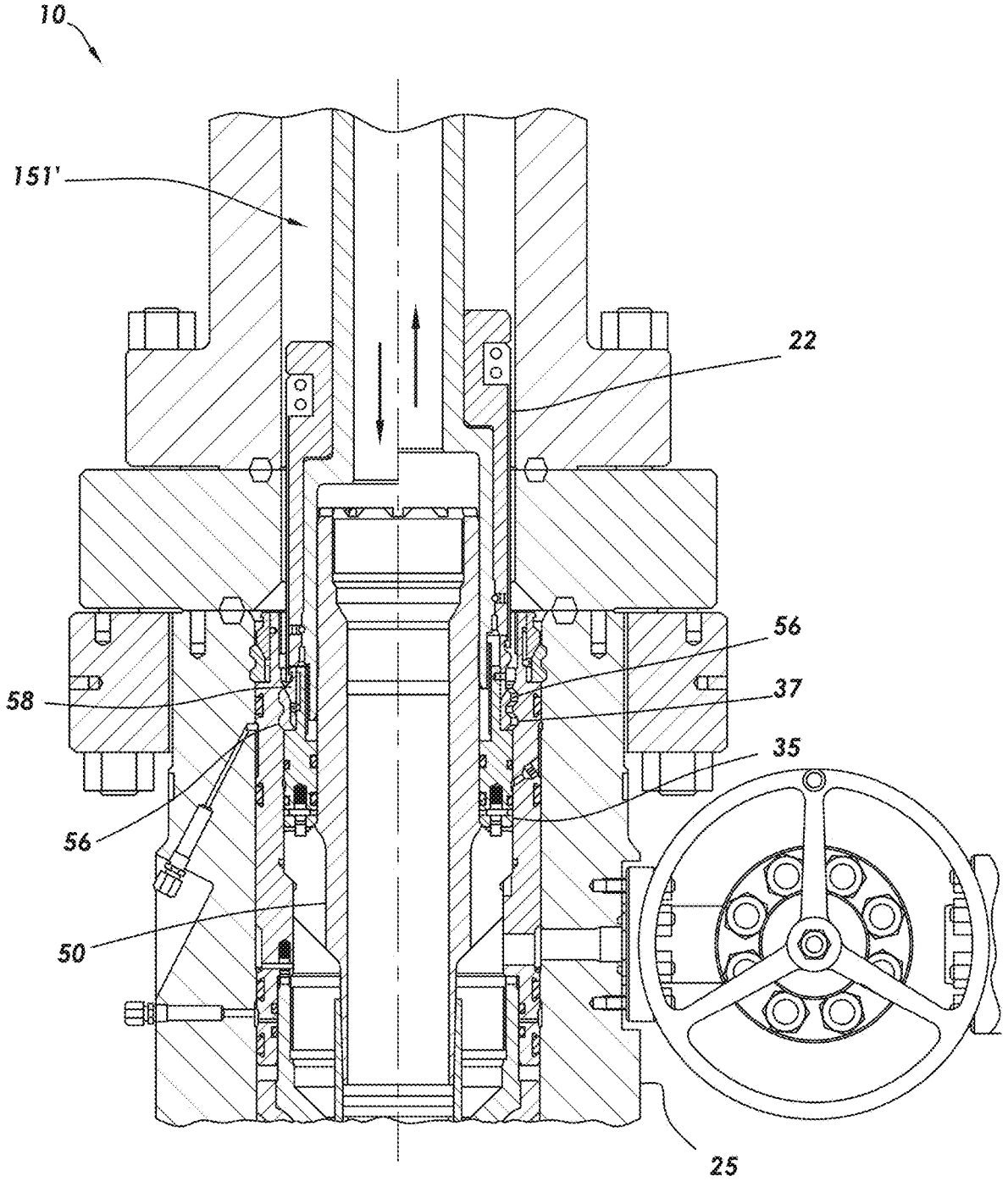
FIG. 10 is a cross section view of the wellhead of FIG. 9 during removal of the tie back string.

Tieback string 50 may be disengaged from wellhead housing 25. In some embodiments, as shown in FIG. 10, wherein tieback string 50 includes tieback lock ring 56 engaged to lock groove 37 of packoff 35, packoff running tool 151' may be used to disengage tieback lock ring 56 from lock groove 37 of packoff 35. In some such embodiments, packoff running tool 151' may be engaged to tieback energizing ring 58 and pulled longitudinally upward to disengage tieback lock ring 56 from lock groove 37 of packoff 35.

Figure 12:
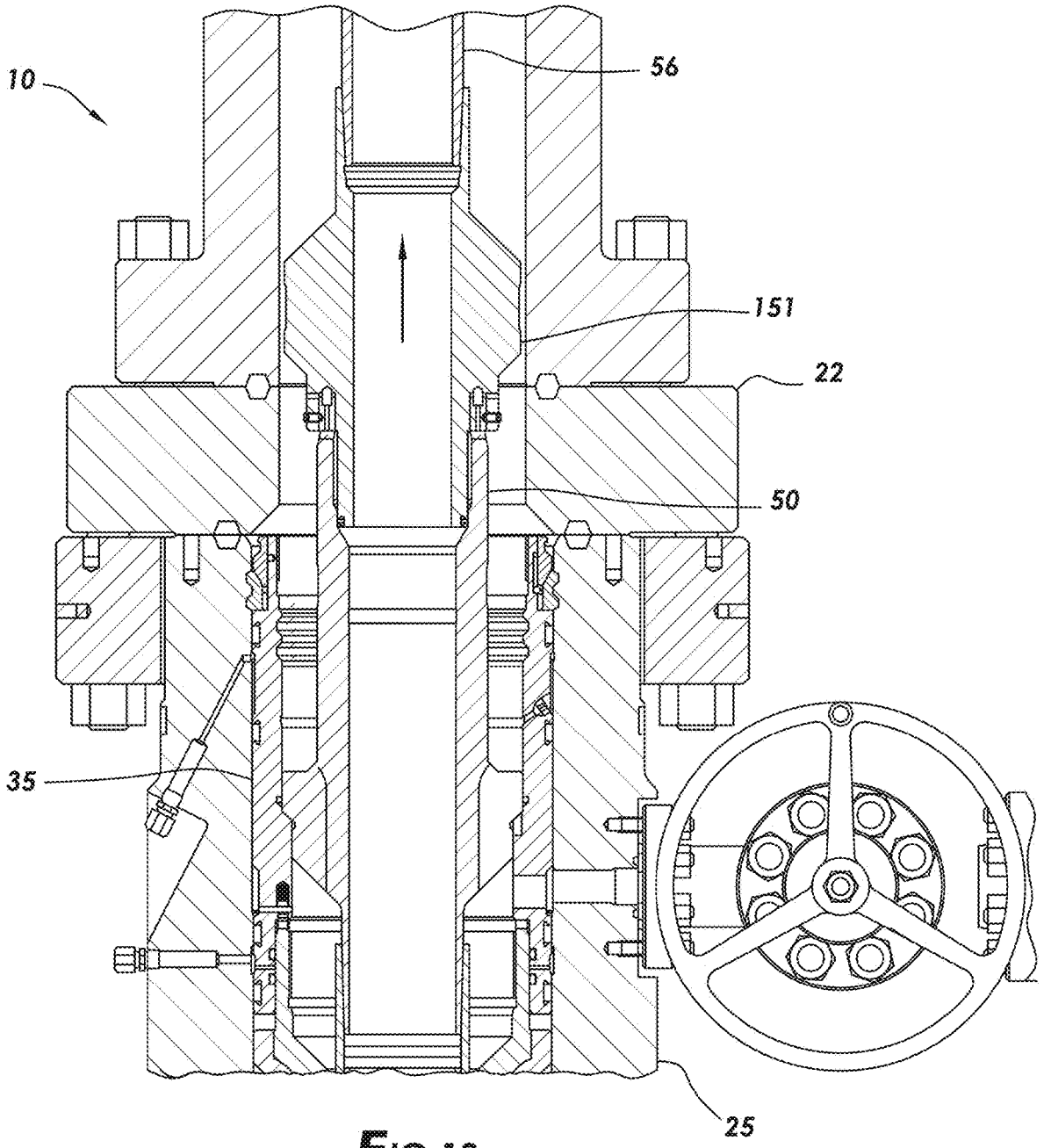
FIG. 12 is a cross section view of the wellhead of FIG. 10 as the tie back string is removed.

Once tieback lock ring 56 is disengaged from lock groove 37, tieback string 50 may be removed from wellhead 10 and wellbore 15 as shown in FIG. 12 by pulling longitudinally upward with running tool 151.

In other embodiments, such as described with respect to wellhead 10' above, tieback string 50 may be released from wellhead 10' by disengaging lockscrews 117' and removing tieback string 50.

Figure 11:
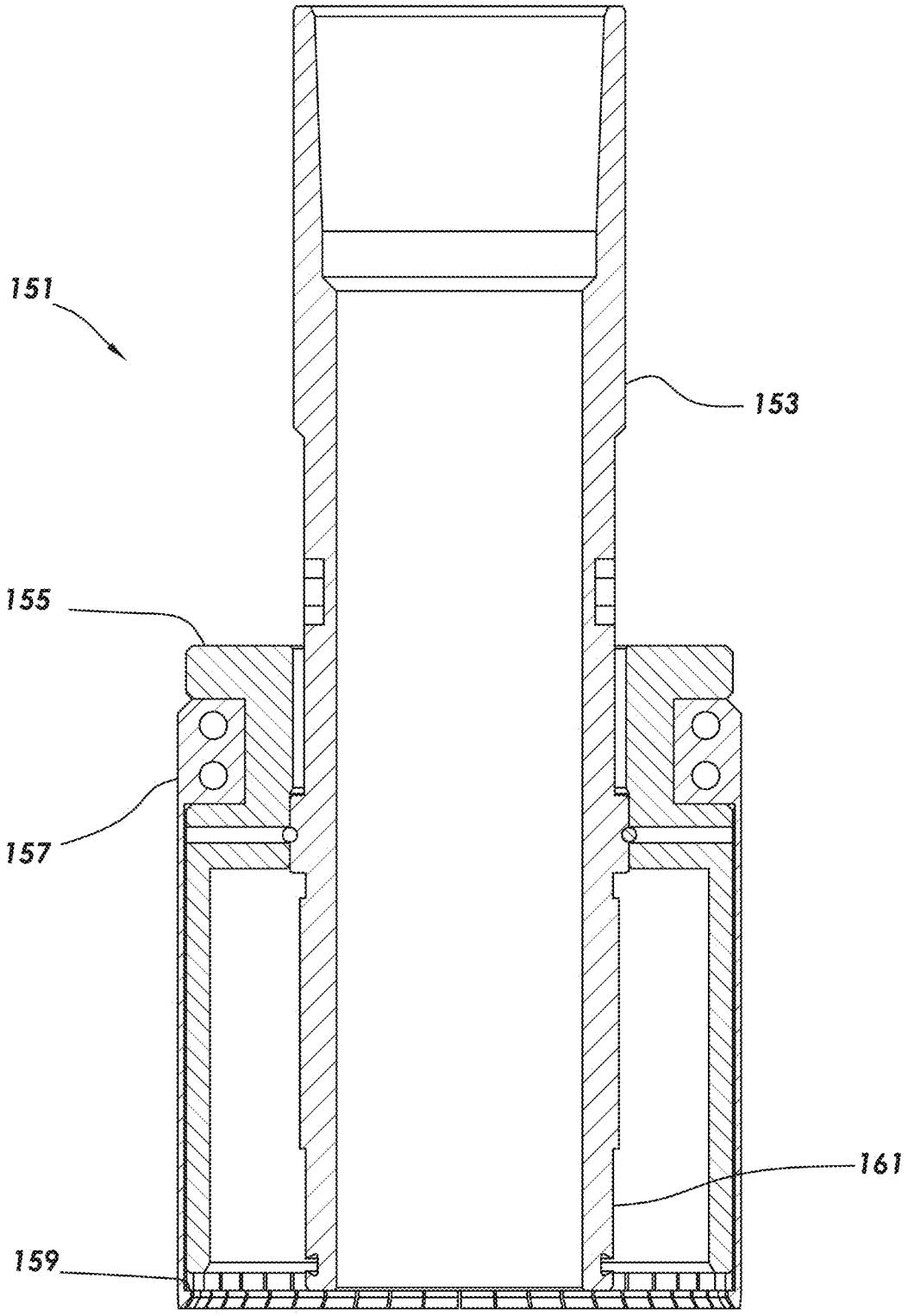
FIG. 11 is a cross section view of a running tool consistent with at least one embodiment of the present disclosure.
Figure 13:
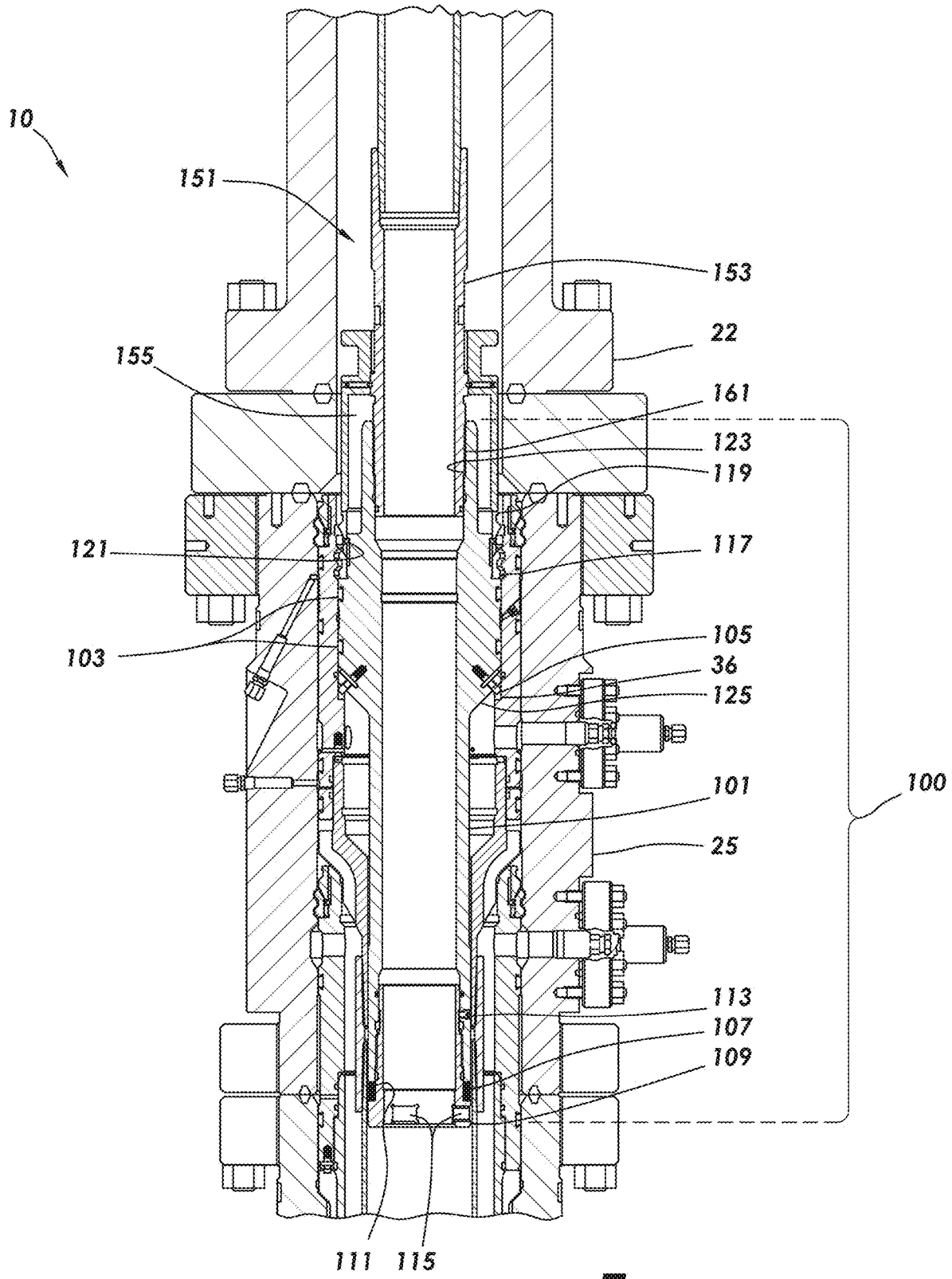
FIG. 13 is a cross section view of the wellhead of FIG. 12 having an isolation sleeve consistent with at least one embodiment of the present disclosure installed thereto in an unlocked, run-in position.
Figure 14:
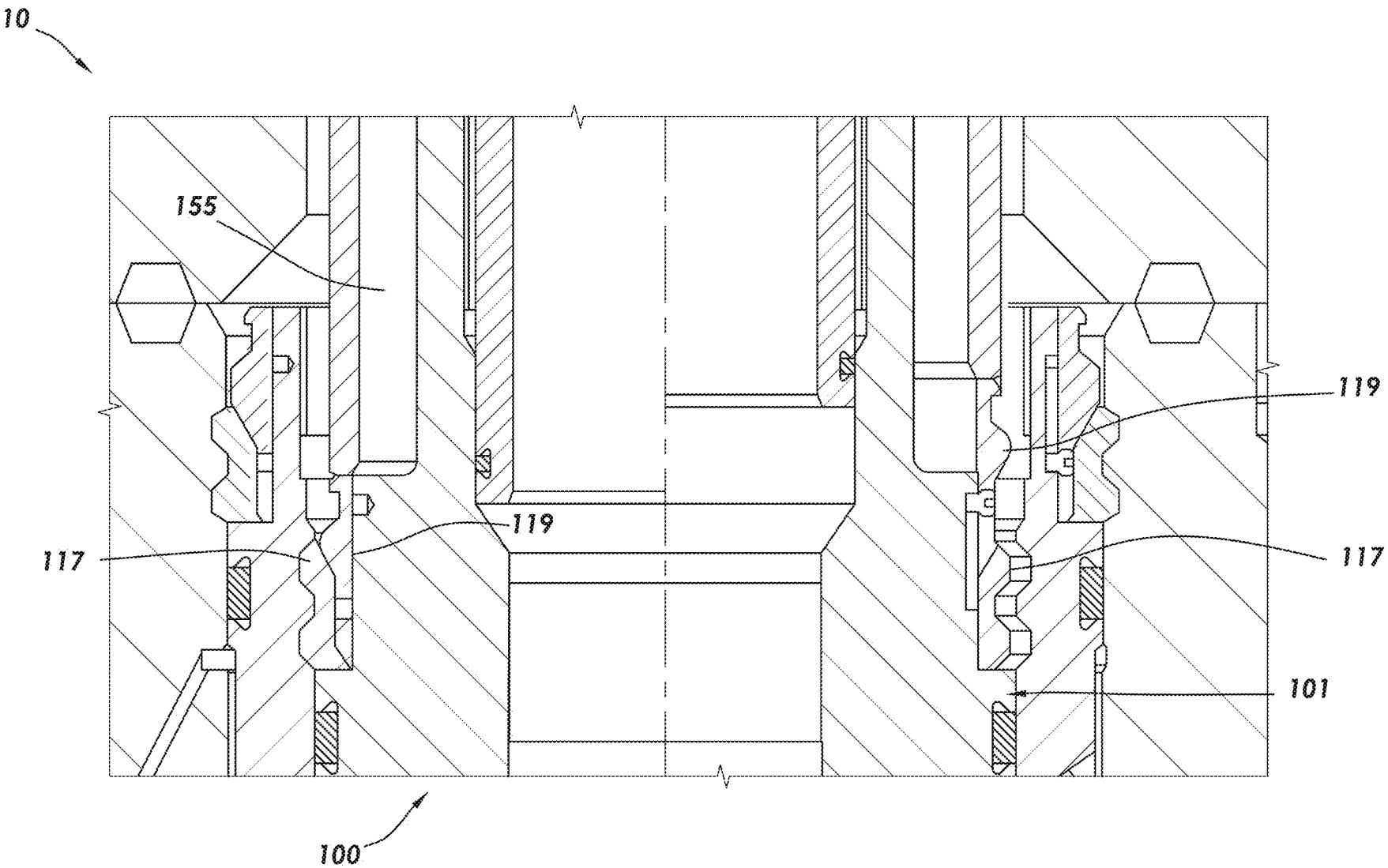
FIG. 14 is a detail view of the isolation sleeve of FIG. 13 in the unlocked and locked configurations.

In some embodiments, once tieback string 50 is removed from wellhead 10, isolation sleeve 100 may be inserted into wellhead 10 as shown in FIG. 13. In some embodiments, isolation sleeve 100 may be positioned into wellhead 10 using running tool 151. FIG. 11 depicts a cross section of running tool 151 consistent with at least one embodiment of the present disclosure. Running tool 151 may include mandrel 153. Running tool 151 may include actuation sleeve 155. Actuation sleeve 155 may be tubular or generally tubular and may be coupled to mandrel 153 such that actuation sleeve 155 may rotate relative to mandrel 153 while being retained longitudinally along mandrel 153. In some embodiments, running tool 151 may include retrieval latch 157. Retrieval latch 157 may, in some embodiments, include one or more hooks 159 positioned to engage with and latch onto energizing ring 119 and allow running tool 151 to pull energizing ring 119 away from lock ring 117. In some embodiments, retrieval latch 157 may be removable from running tool 151 to, for example and without limitation, allow running tool 151 to set energizing ring 119 of isolation sleeve 100 as further discussed below.

In some embodiments, mandrel 153 may include lower threaded connection 161 adapted to threadedly engage tubular members positioned within wellhead 10 including, for example and without limitation, isolation sleeve body 101 such that rotation of mandrel 153 may allow engagement between actuation sleeve 155 and lock ring 117.

As shown in FIG. 13, isolation sleeve 100 may be positioned into wellhead 10 using running tool 151 with retrieval latch 157 removed therefrom. In such an embodiment, mandrel 153 may be partially threadedly coupled to upper threaded receiver 123 of sleeve body 101, thereby allowing isolation sleeve 100 to be moved by movement of running tool 151 and inserted into wellhead 10.

Isolation sleeve 100 may be inserted into wellhead 10 until landing shoulder 125 engages packoff 35. In some embodiments, isolation sleeve 100 may be locked to wellhead 10. For example, in some embodiments, running tool 151 may be rotated such that mandrel 153 urges actuation sleeve 155 into abutment with energizing ring 119. In some embodiments, rotation of running tool 151 may cause rotation of isolation sleeve 100 relative to wellhead 10. In some such embodiments, isolation sleeve 100 may rotate until antirotation pins 105 engage slots 36, at which point antirotation pins 105 may reduce or prevent further rotation of isolation sleeve 100. Further rotation of running tool 151 may cause energizing ring 119 to move such that lock ring 117 is urged radially outward and into engagement with lock groove 37 of packoff 35 as shown on the left side of FIG. 14.

Figure 15A:
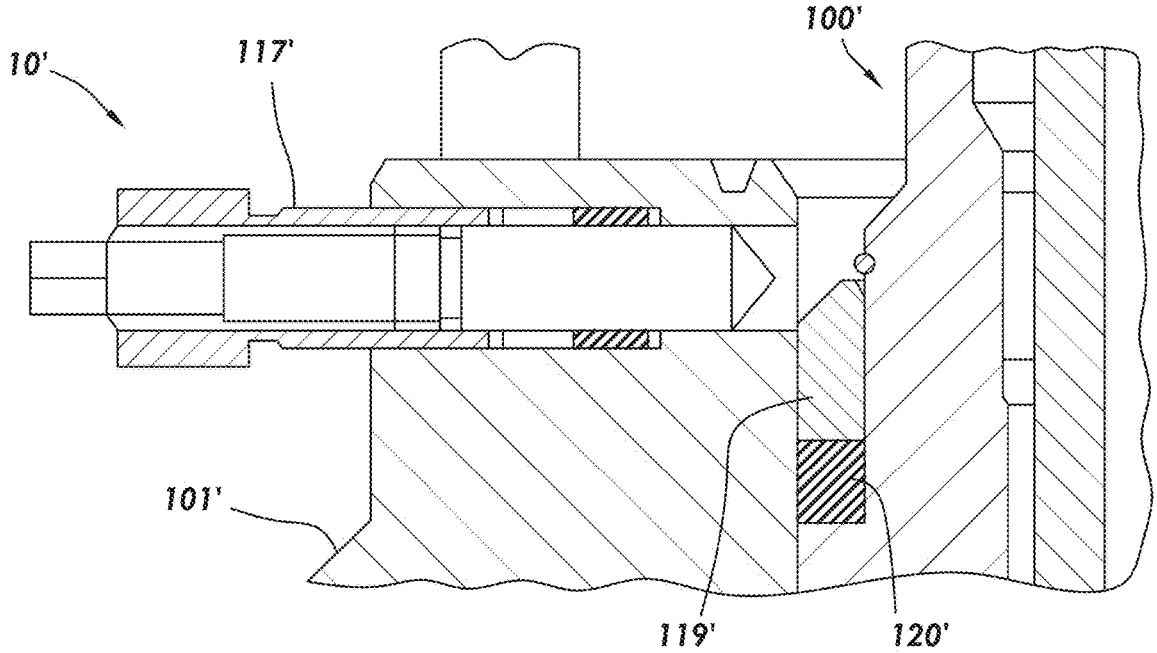
FIGS. 15A, 15B are detail views of the isolation sleeve of FIG. 6 in the unlocked and locked configurations respectively.
Figure 15B:
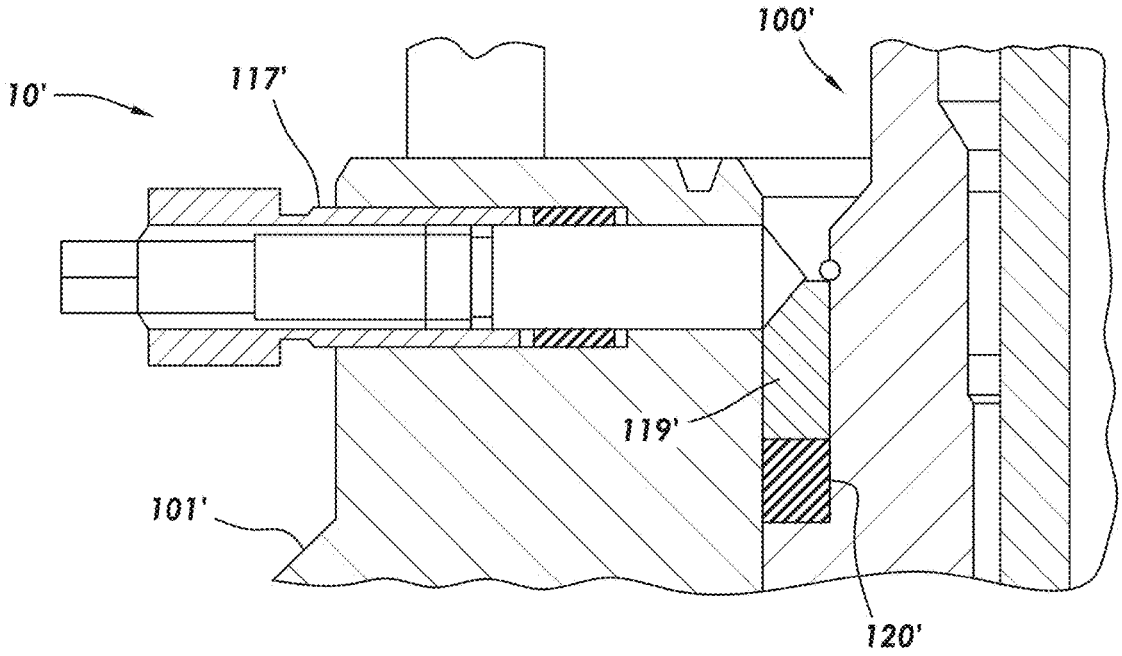

In other embodiments in which isolation sleeve 100' is locked to wellhead 10' using lockscrews 117', isolation sleeve 100' may be inserted to wellhead 10' while lockscrews 117' are in a disengaged position as shown in FIG. 15A. Lockscrews 117' may then be engaged to wellhead 10' as shown in FIG. 15B such that isolation sleeve 100' is locked to wellhead 10'. In some embodiments, lockscrews 117' may engage seal ring 119' and may urge seal ring 119' against upper body seal 120' such that upper body seal 120' is compressed along the longitudinal axis of isolation sleeve 100' and is thereby urged radially outward into engagement with wellhead 10'.

Once isolation sleeve 100 is locked to wellhead 10, one or more pressure tests of wellhead 10 may be undertaken including, for example and without limitation, testing of seals 40 and 103 (or 120').

Figure 16:
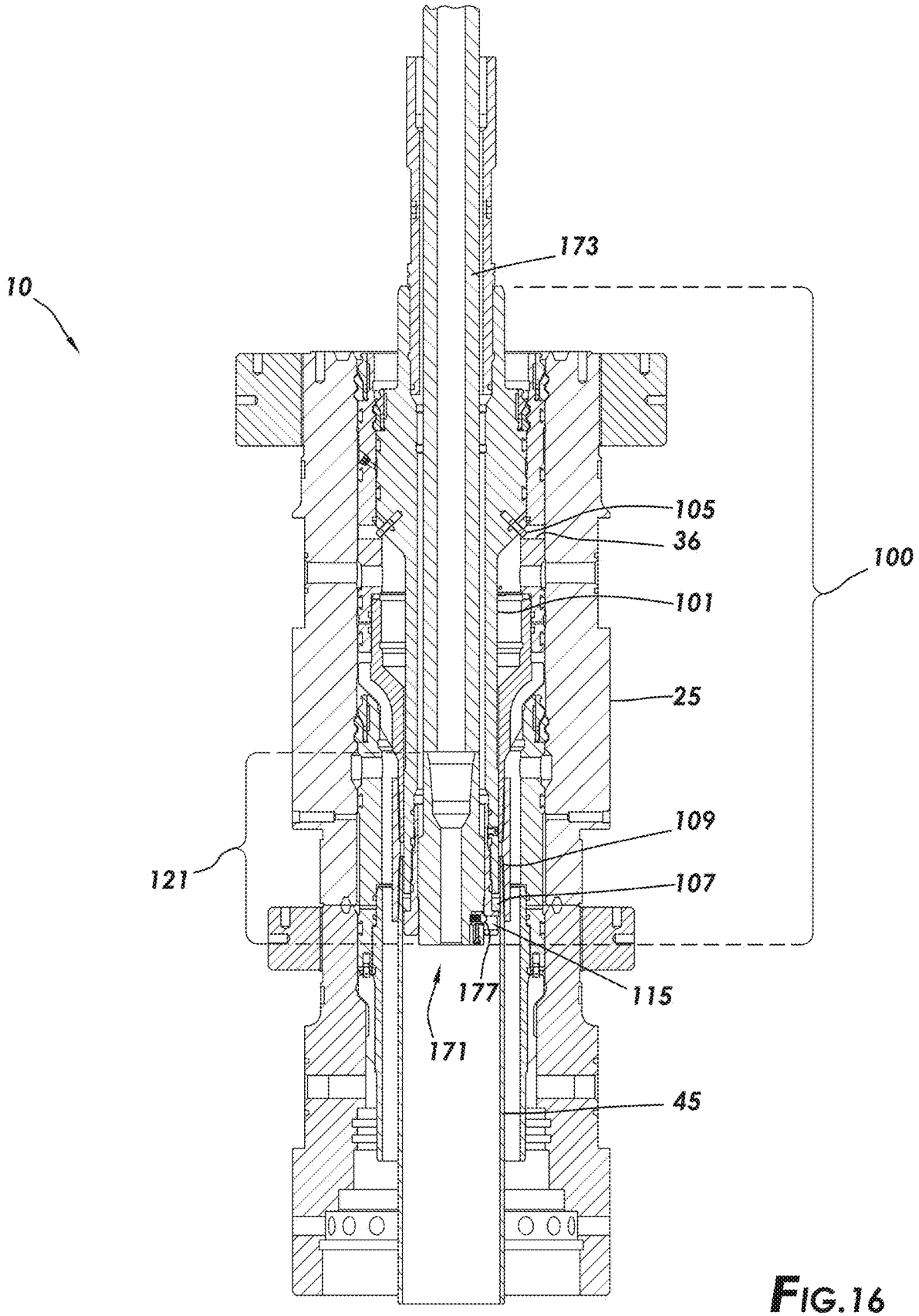
FIG. 16 is a cross section view of the wellhead of FIG. 12 having a torque tool consistent with at least one embodiment of the present disclosure installed to the isolation sleeve thereof.

Compression seal 107 may then be engaged to casing 45. In some embodiments, torque tool 171 may be positioned within isolation sleeve 100 as shown in FIG. 16. In some embodiments, torque tool 171 may be coupled to drill pipe or other tubular 173 such that torque tool 171 may be positioned into isolation sleeve 100.

Figure 17:
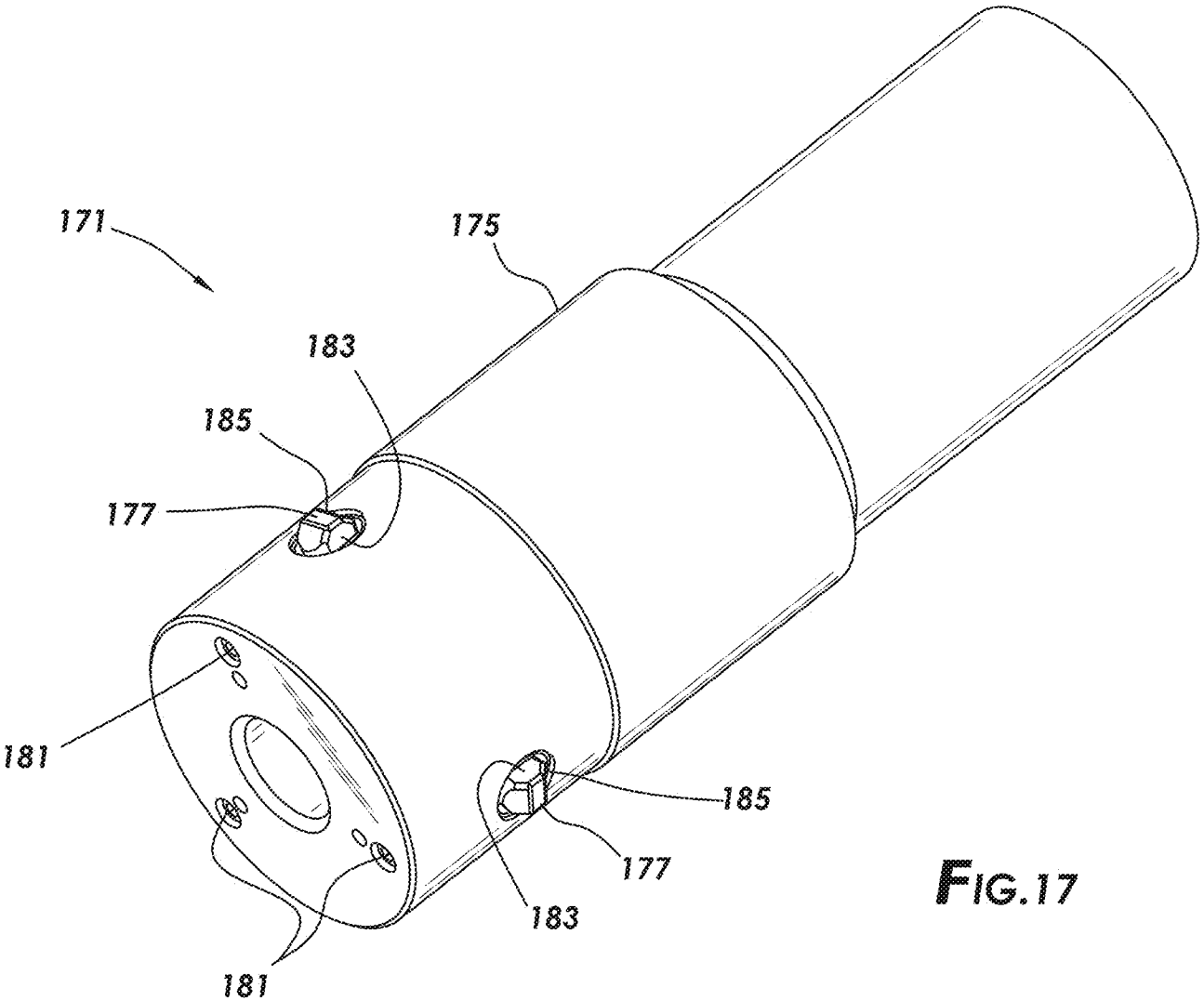
FIG. 17 is a perspective view of a torque tool consistent with at least one embodiment of the present disclosure.
Figure 18:
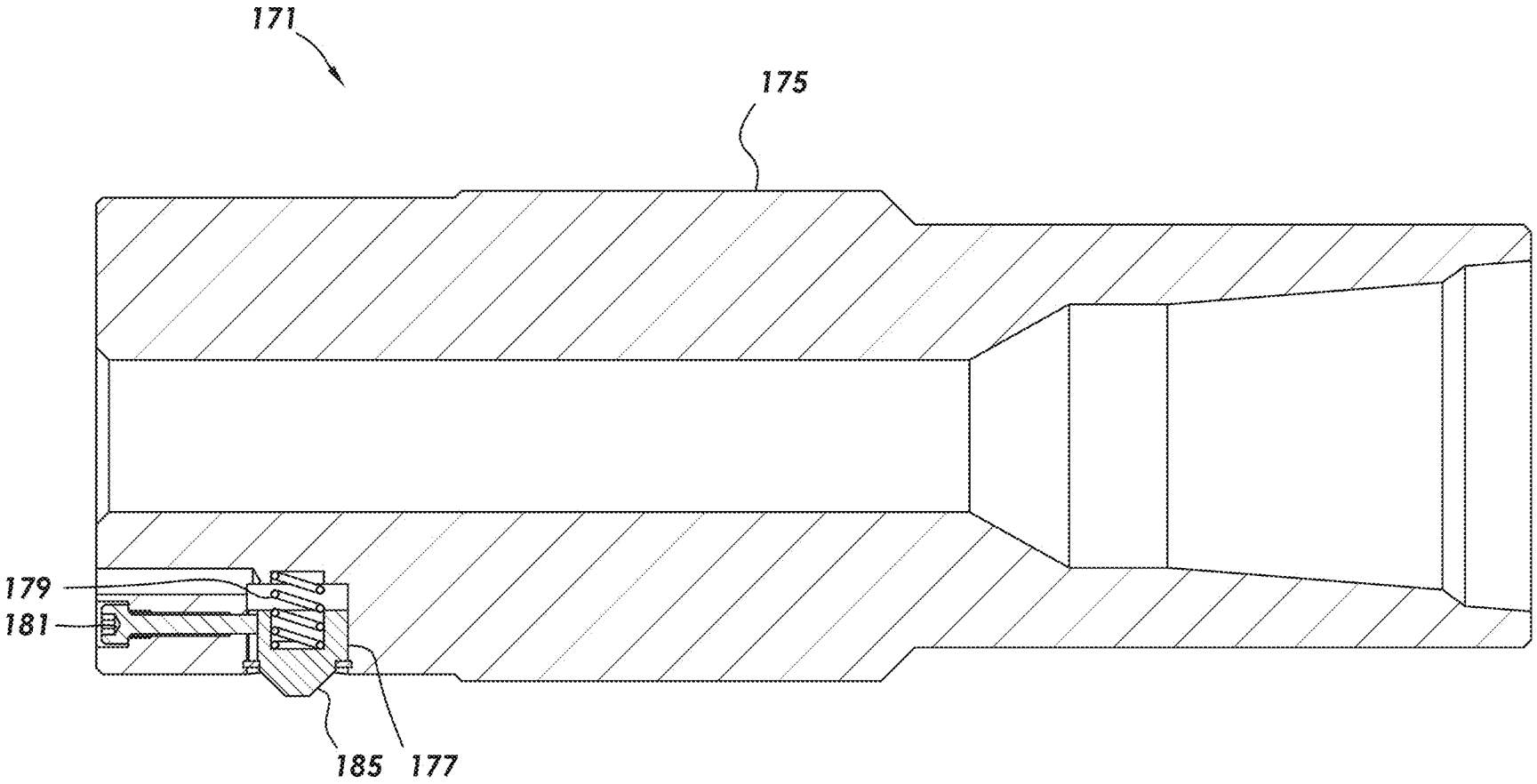
FIG. 18 is a cross section view of the torque tool of FIG. 17.

As shown in FIGS. 17, 18, torque tool 171 may include torque tool body 175. In some embodiments, torque tool 171 may include one or more torque dogs 177. Each torque dog 177 may be positioned in an opening formed in torque tool body 175 such that each such torque dog 177 extends radially from the outer surface of torque tool body 175. In some embodiments, as shown in FIG. 18, each torque dog 177 may be urged radially outward by a corresponding spring 179. Torque dogs 177 may thereby be able to radially retract within the diameter of tubular members encountered while being inserted into isolation sleeve 100. In some embodiments, torque tool 171 may include one or more retention fasteners 181 adapted to limit the radial extension of torque dogs 177 from torque tool body 175 and prevent torque dogs 177 from becoming disconnected from torque tool body 175.

In some embodiments, each torque dog 177 may include flat sidewall 183. Flat sidewall 183 may be positioned to engage rotation slots 115 of torque sleeve 109 as further discussed below. In some embodiments, each torque dog 177 may include tapered upper surface 185. Tapered upper surface 185 may, for example and without limitation, allow torque dog 177 to be urged radially into torque tool body 175 by torque sleeve 109 as torque tool 171 is moved longitudinally upward and torque dogs 177 move out of alignment with rotation slots 115, thereby allowing torque tool 171 to be removed from isolation sleeve 100 as further discussed below.

With reference to FIG. 16, torque tool 171 may be inserted into isolation sleeve 100 until torque dogs 177 are longitudinally aligned with rotation slots 115. Torque tool 171 may then be rotated until torque dogs 177 engage with rotation slots 115, shown in detail in FIG. 19. Torque tool 171 may then be further rotated such that flat sidewall 183 of each torque dog 177 engages a corresponding rotation slot 115 of torque sleeve 109 and thereby causes rotation of torque sleeve 109.

Figure 21:
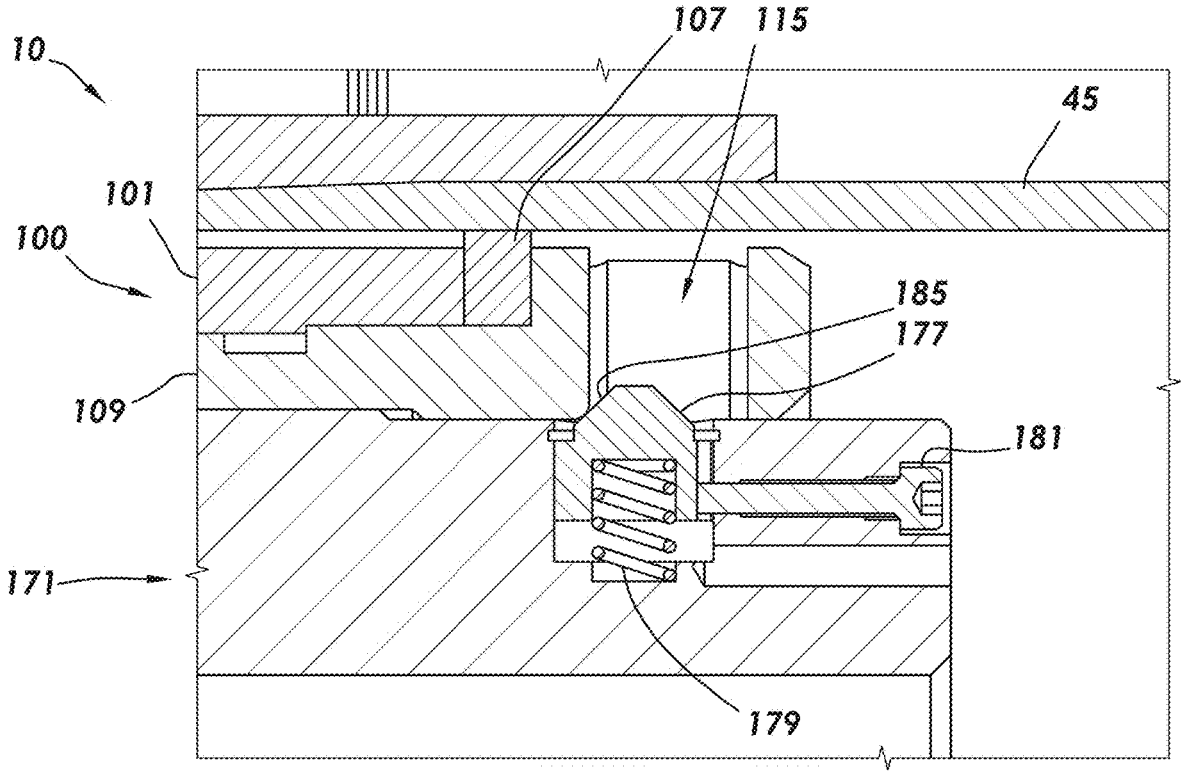
FIG. 21 is a detail view of the torque tool and isolation sleeve of FIG. 19 in the set configuration.
Figure 20:
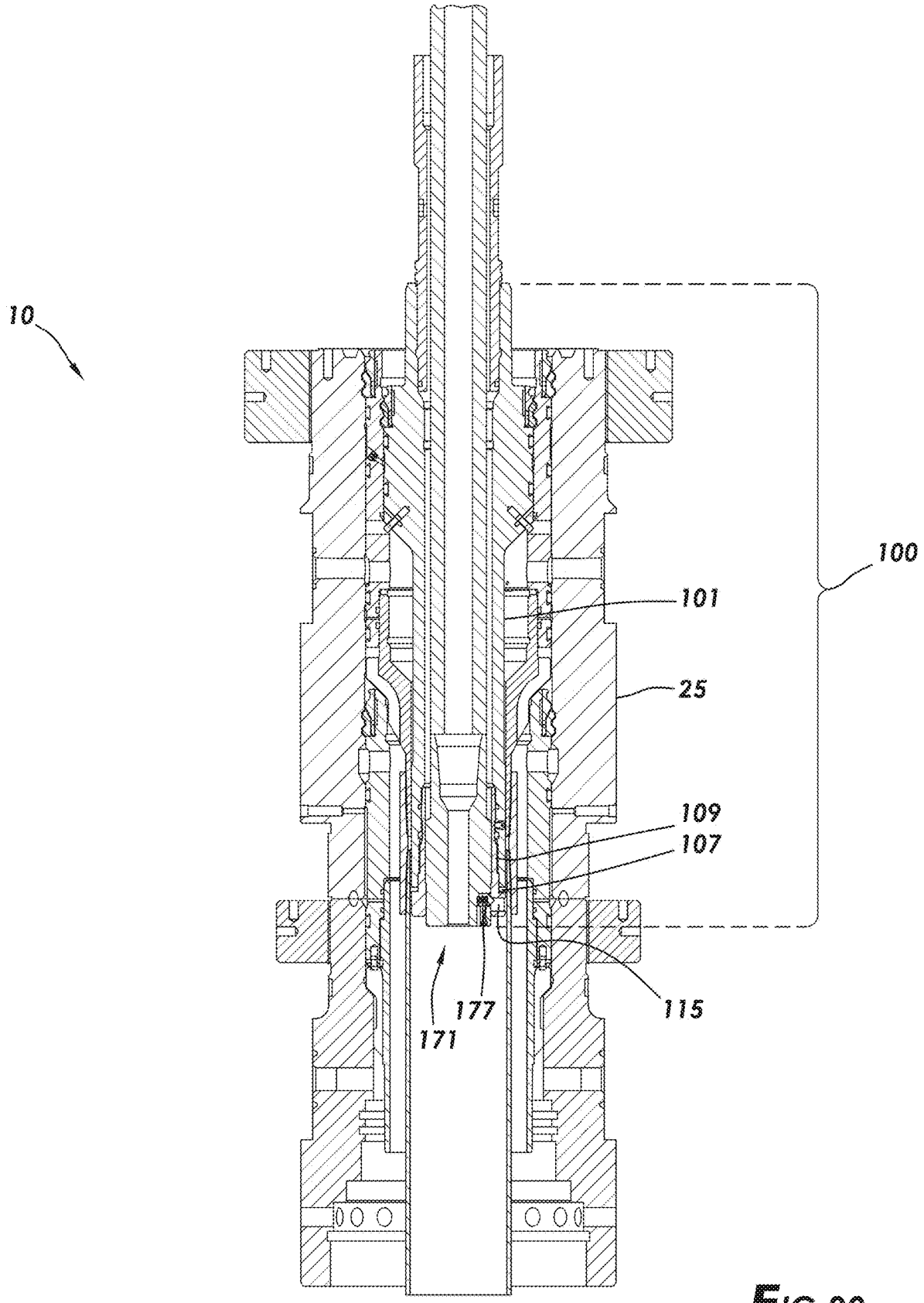
FIG. 20 is a cross section view of the wellhead of FIG. 13 in the set configuration.

In some embodiments, as torque sleeve 109 is rotated, torque sleeve 109 is further threadedly engaged to sleeve body 101, causing compression seal 107 to be compressed along the axis of isolation sleeve 100 as shown in FIG. 20 and in detail in FIG. 21. Compression seal 107 is thereby extruded radially outward into contact with casing 45 thereby reducing or preventing fluid flow between isolation sleeve 100 and casing 45 and into bore 30 of wellhead 10. Isolation sleeve 100 is thereby placed in the set position.

Torque tool 171 may then be removed from isolation sleeve 100 by moving longitudinally upward as tapered upper surface 185 of each torque dog 177 allows torque dogs 177 to be urged radially inward and are thereby allowed to escape from rotation slots 115 of torque sleeve 109. BOP 22 may then be removed and tubing head 20 may be replaced to wellhead housing 25 as shown in FIG. 2, thus completing the installation of isolation sleeve 100. A tubing hanger or any other tool may be placed into wellbore 15 through wellhead 10 and isolation sleeve 100.

In some embodiments, isolation sleeve 100, 100' may be adapted to be installed into wellhead 10, 10' without any other modifications to wellhead 10, 10', thereby allowing isolation sleeve 100, 100' to be retrofitted into an existing wellhead 10, 10'.

One of ordinary skill in the art with the benefit of this disclosure will understand that isolation sleeve 100 may be installed to wellhead 10 without having to first remove any components including, for example, tieback string 50. Such operations are merely examples of operations that may be undertaken before isolation sleeve 100 is installed to wellhead 10.

Additionally, in some embodiments, isolation sleeve 100 may be uninstalled from wellhead 10 by, for example and without limitation, substantially reversing the above-described operations.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A wellhead system configured to be secured on a wellbore, comprising:

a wellhead housing;

a casing hanger configured to land within the wellhead housing to suspend a casing string within the wellbore; and an isolation sleeve assembly secured within the wellhead housing during use, wherein the isolation sleeve assembly comprises:

a sleeve body that defines a sleeve bore, wherein the sleeve body is inserted into a casing bore of the casing string during use and a lower end of the sleeve body comprises internal threading;

a torque sleeve, wherein:

another lower end of the torque sleeve comprises an upward-facing compression shoulder; and an upper end of the torque sleeve comprises external threading that engages the internal threading at the lower end of the sleeve body such that the upward-facing compression shoulder on the torque sleeve axially opposes the lower end of the sleeve body; and a compression seal disposed circumferentially around the torque sleeve between the upward-facing compression shoulder on the torque sleeve and the lower end of the sleeve body, wherein tightening the torque sleeve on the sleeve body is configured to axially compress the compression seal such that the compression seal is radially compressed against an inner surface of the casing string;

a tubing head secured on the wellhead housing during use, wherein:

another upper end of the sleeve body comprises another upward-facing compression shoulder; and the isolation sleeve assembly comprises:

a beveled seal ring disposed circumferentially around the another upper end of the sleeve body such that a further lower end of the beveled seal ring axially opposes the another upward-facing compression shoulder of the sleeve body; and an upper body seal disposed circumferentially around the another upper end of the sleeve body between the beveled seal ring and the another upward-facing compression shoulder of the sleeve body; and a lock screw configured to be secured radially through the tubing head, wherein tightening the lock screw against the beveled seal ring is configured to axially compress the upper body seal between the beveled seal ring and the another upward-facing compression shoulder of the sleeve body such that the upper body seal is radially compressed against another inner surface of the tubing head.

2. The wellhead system of claim 1, comprising a running tool configured to be selectively secured to the another upper end of the sleeve body to facilitate inserting the isolation sleeve assembly into the casing bore of the casing string, withdrawing the isolation sleeve assembly from the casing bore of the casing string, or both.

3. The wellhead system of claim 1, comprising a torque tool, wherein:

the torque sleeve of the isolation sleeve assembly comprises an internal rotation slot; and the torque tool comprises:

a tool body configured to be inserted into the sleeve bore of the isolation sleeve assembly; and a torque dog configured to selectively extend radially out from the tool body and engage the internal rotation slot in the torque sleeve to facilitate rotating the torque sleeve using the torque tool.

4. The wellhead system of claim 3, wherein:

the torque dog is disposed within an opening in the tool body; and the torque tool comprises a spring disposed within the opening between the tool body and the torque dog.

5. The wellhead system of claim 3, wherein the torque dog of the torque tool comprises:

a chamfered external upper edge configured to facilitate disengaging the torque dog from the internal rotation slot in the torque sleeve as the torque tool is withdrawn from the sleeve bore of the isolation sleeve assembly; and a first flat sidewall configured to facilitate maintaining the torque dog within the internal rotation slot in the torque sleeve while the torque tool is used to rotate the torque sleeve in a first direction; and a second flat sidewall configured to facilitate maintaining the torque dog within the internal rotation slot in the torque sleeve while the torque tool is used to rotate the torque sleeve in a second direction.

6. A wellhead system comprising an isolation sleeve assembly, wherein the isolation sleeve assembly comprises:

a sleeve body that defines a sleeve bore, wherein a lower end of the sleeve body comprises internal threading and the sleeve body is inserted into a wellhead bore during use;

a torque sleeve, wherein:

another lower end of the torque sleeve comprises an upward-facing compression shoulder; and an upper end of the torque sleeve comprises external threading configured to engage the internal threading at the lower end of the sleeve body; and a compression seal configured to be disposed circumferentially around the torque sleeve between the upward-facing compression shoulder on the torque sleeve and the lower end of the sleeve body, wherein tightening the torque sleeve on the sleeve body is configured to axially compress the compression seal such that the compression seal is radially compressed against an internal surface that defines the wellhead bore; and a torque tool, wherein:

the torque sleeve of the isolation sleeve assembly comprises an internal rotation slot; and the torque tool comprises:

a tool body configured to be inserted into the sleeve bore of the isolation sleeve assembly; and a torque dog configured to selectively extend radially out from the tool body and engage the internal rotation slot in the torque sleeve to facilitate rotating the torque sleeve using the torque tool.

7. The wellhead system of claim 6, comprising another wellhead component that at least partially defines the wellhead bore, wherein:

the another wellhead component comprises an internal lock groove; and the isolation sleeve assembly is configured to land in the another wellhead component and comprises a lock ring disposed circumferentially around another upper end of the sleeve body, wherein the lock ring is configured to expand radially outward into engagement with the internal lock groove in the another wellhead component to facilitate securing the isolation sleeve within the wellhead system.

8. The wellhead system of claim 7, wherein the isolation sleeve assembly comprises an energizing ring configured to be axially pushed such that the energizing ring is disposed radially between the sleeve body and the lock ring to facilitate expanding the lock ring radially outward into engagement with the internal lock groove in the another wellhead component.

9. The wellhead system of claim 6, comprising another wellhead component that at least partially defines the wellhead bore, wherein the isolation sleeve assembly is configured to land in the another wellhead component and comprises an isolation seal configured to be:

disposed circumferentially around the sleeve body of the isolation sleeve assembly; and radially compressed between the sleeve body and the another wellhead component.

10. The wellhead system of claim 6, comprising another wellhead component that at least partially defines the wellhead bore, wherein:

the another wellhead component comprises an internal slot or hole; and the isolation sleeve assembly comprises a spring-loaded anti-rotation pin configured to engage the internal slot or hole in the another wellhead component to facilitate blocking rotation of the isolation sleeve assembly within the wellhead system.

11. The wellhead system of claim 6, wherein:

the torque dog is disposed within an opening in the tool body; and the torque tool comprises a spring disposed within the opening between the tool body and the torque dog.

12. The wellhead system of claim 6, wherein the torque dog of the torque tool comprises:

a chamfered external upper edge configured to facilitate disengaging the torque dog from the internal rotation slot in the torque sleeve as the torque tool is withdrawn from the sleeve bore of the isolation sleeve assembly; and a first flat sidewall configured to facilitate maintaining the torque dog within the internal rotation slot in the torque sleeve while the torque tool is used to rotate the torque sleeve in a first direction; and a second flat sidewall configured to facilitate maintaining the torque dog within the internal rotation slot in the torque sleeve while the torque tool is used to rotate the torque sleeve in a second direction.

13. A wellhead system comprising an isolation sleeve assembly, wherein the isolation sleeve assembly comprises:

a sleeve body that defines a sleeve bore, wherein a lower end of the sleeve body comprises internal threading and the sleeve body is inserted into a wellhead bore during use;

a torque sleeve, wherein:

another lower end of the torque sleeve comprises an upward-facing compression shoulder; and an upper end of the torque sleeve comprises external threading configured to engage the internal threading at the lower end of the sleeve body; and a compression seal configured to be disposed circumferentially around the torque sleeve between the upward-facing compression shoulder on the torque sleeve and the lower end of the sleeve body, wherein tightening the torque sleeve on the sleeve body is configured to axially compress the compression seal such that the compression seal is radially compressed against an internal surface that defines the wellhead bore;

another wellhead component that at least partially defines the wellhead bore, wherein:

another upper end of the sleeve body comprises another upward-facing compression shoulder; and the isolation sleeve assembly comprises:

a beveled seal ring configured to be disposed circumferentially around the another upper end of the sleeve body; and an upper body seal configured to be disposed circumferentially around the another upper end of the sleeve body between the beveled seal ring and the another upward-facing compression shoulder of the sleeve body; and a lock screw secured radially through the another wellhead component during use, wherein tightening the lock screw against the beveled seal ring is configured to axially compress the upper body seal between the beveled seal ring and the another upward-facing compression shoulder of the sleeve body such that the upper body seal is radially compressed against another internal surface of the another wellhead component.

* * * * *